US007153812B2

(12) United States Patent
Hara

(10) Patent No.: US 7,153,812 B2
(45) Date of Patent: Dec. 26, 2006

(54) HEAT-SENSITIVE RECORDING MATERIAL

(75) Inventor: Toshio Hara, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 274 days.

(21) Appl. No.: 10/809,952

(22) Filed: Mar. 26, 2004

(65) Prior Publication Data

US 2004/0192548 A1 Sep. 30, 2004

(30) Foreign Application Priority Data

Mar. 28, 2003 (JP) ..... 2003-091633

(51) Int. Cl.
*B41M 5/40* (2006.01)

(52) U.S. Cl. ..... 503/200; 503/226

(58) Field of Classification Search ..... 503/200–227
See application file for complete search history.

(56) References Cited

FOREIGN PATENT DOCUMENTS

JP 2002-283730 A 10/2002

*Primary Examiner*—Bruce H. Hess
(74) *Attorney, Agent, or Firm*—Sughrue Mion, PLLC

(57) ABSTRACT

A heat-sensitive recording material comprising, on a support, a heat-sensitive recording layer and a protective layer is provided. The protective layer contains an acetylene glycol derivative represented by the following formula (1) in an amount of 2% by mass or more, a water-insoluble dispersion in an amount of 5% by mass or more, and a water-insoluble organic material, as an emulsion, in an amount of 5% by mass or more, all based on the solids content in the protective layer.

Formula (1)

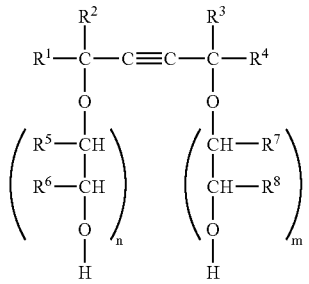

In formula (1), $R^1$ to $R^4$ each independently represent a hydrogen atom, a branched, linear or cyclic substituted or unsubstituted alkyl group having 1 to 8 carbon atoms, or a substituted or unsubstituted aryl group having 6 to 10 carbon atoms. $R^5$ to $R^8$ each independently represent a hydrogen atom or a methyl group. n and m each independently represent an integer of 0 to 50.

18 Claims, No Drawings

HEAT-SENSITIVE RECORDING MATERIAL

CROSS-REFERENCE TO RELATED APPLICATION

This application claims priority under 35 USC 119 from Japanese patent Application No. 2003-91633, the disclosure of which is incorporated by reference herein.

BACKGROUND OF THE INVENTION

1. Field of the Invention

The present invention relates to a heat-sensitive recording material, specifically, a high image-quality heat-sensitive recording material suitable for medical recording media and the like.

2. Description of the Related Art

In recent years, the heat-sensitive recording method has been developing in various fields since the method has advantages, for example, as-the following: (1) no development is necessary, (2) if the support of heat-sensitive recording material is paper, the paper is like a general paper, (3) operation is easy, (4) color density of the resultant image is high, (5) a recorder is simple, highly reliable and inexpensive, (6) no noise occurs at the time of recording, and (7) no maintenance is needed. The use of the heat-sensitive recording method has been expanding over the field of facsimile and printer, the field of label such POS, and other fields.

As heat-sensitive recording materials used in the heat-sensitive recording, a material using reaction between an electron-donating colorless dye and an electron-accepting compound, a material using reaction between a diazo compound and a coupler, and the like materials have been widely known.

In recent years, there is a need for developing heat-sensitive recording materials having a heat-sensitive recording layer on a transparent support, an image being able to be recorded on the heat-sensitive recording material directly by means of a thermal head, so that a recorded image can be projected through an overhead projector or the image can be observed directly on a light table. Attention has been paid, in particular, to transparent heat-sensitive recording materials as materials for forming images for medical diagnosis.

Although the transparency of such transparent heat-sensitive recording materials themselves is good, the materials have problems that when images are recorded on the materials with a heat-sensitive recording device such as a thermal printer, sticking or noise easily occurs. In particular, when transparent heat-sensitive recording materials are used for medical use, a high transmission density is required for the materials; therefore, thermal energy applied by means of a thermal head becomes large so that problems such as sticking, noise in the recording, and the abrasion of the thermal head become serious. Thus, a protective layer consisting mainly of a pigment and a binder is provided on the heat-sensitive recording layer in order to suppress sticking and noise. Besides the protective layer, at least one selected from gas blocking layers, undercoat layers, ultraviolet ray filter layers, antireflection layers and other layers can also be provided.

In order to provide these layers on a support, there are known a method of forming the respective layers successively over the support, and a method of forming all the layers simultaneously by multilayer coating in an extruding die manner.

The multilayer coating method is preferable since an underlying layer does not influence a layer on the underlying layer and no liquid repellent mark is generated. However, when the coating speed is increased in order to make the efficiency of the production high, the dried surface becomes uneven and the state of the surface tends to deteriorate.

In particular, when a transparent heat-sensitive recording material is used to produce an image for medical diagnosis, precise diagnosis cannot be attained if details of formed image are not clear. Deterioration of surface state of a heat-sensitive recording material exerts a bad influence on formed image.

In order to solve the above-mentioned problems, a heat-sensitive recording material comprising a specific acetylene glycol derivative is suggested, and surface deficiency is largely reduced (for example, Japanese Patent Application Laid-Open (JP-A) No. 2002-283730).

It has been requested that in a heat-sensitive recording material, in particular, in a heat-sensitive recording material applied to medical diagnosis, surface deficiency should be further reduced so as to form high-quality images.

SUMMARY OF THE INVENTION

The present invention has been made considering the above-mentioned problems. An object of the invention is to provide a heat-sensitive recording material which has a satisfactory surface state and is capable of forming a high-quality image.

The above-mentioned problems can be solved by the following heat-sensitive recording materials.

A first aspect of the present invention is a heat-sensitive recording material (S) comprising, on a support, at least a heat-sensitive recording layer and a protective layer in that order, wherein the protective layer contains an acetylene glycol derivative represented by the following formula (1) in an amount of 2% or more by mass of solid content in the protective layer, a water-insoluble dispersion in an amount of 5% or more by mass of the solid content in the protective layer, and a water-insoluble organic material in a form of an emulsion in an amount of 5% or more by mass of the solid content in the protective layer:

Formula (1)

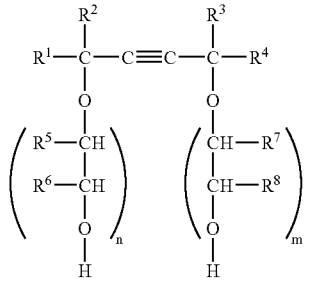

wherein in formula (1), $R^1$ to $R^4$ each independently represent a hydrogen atom, a substituted or unsubstituted alkyl group which is branched, linear or cyclic having 1 to 8 carbon atoms, or a substituted or unsubstituted aryl group having 6 to 10 carbon atoms; $R^5$ to $R^8$ each independently represent a hydrogen atom or a methyl group; and n and m each independently represent an integer of 0 to 50.

A second aspect of the invention is the heat-sensitive recording material (S), wherein the sum of n and m in formula (1) is 6 or less.

A third aspect of the invention is the heat-sensitive recording material (S), wherein $R^1$ in formula (1) is selected from the group consisting of methyl, ethyl, n-propyl, isopropyl, n-butyl, isobutyl, cyclohexyl, phenyl and naphthyl groups.

A fourth aspect of the invention is the heat-sensitive recording material (S), wherein $R^2$ in formula (1) is selected from the group consisting of methyl, ethyl, n-propyl, isopropyl, n-butyl, isobutyl, cyclohexyl, phenyl and naphthyl groups.

A fifth aspect of the invention is the heat-sensitive recording material (S), wherein $R^3$ in formula (1) is selected from the group consisting of methyl, ethyl, n-propyl, isopropyl, n-butyl, isobutyl, cyclohexyl, phenyl and naphthyl groups.

A sixth aspect of the invention is the heat-sensitive recording material (S), wherein $R^4$ in formula (1) is selected from the group consisting of methyl, ethyl, n-propyl, isopropyl, n-butyl, isobutyl, cyclohexyl, phenyl and naphthyl groups.

A seventh aspect of the invention is the heat-sensitive recording material (S), wherein the water-insoluble dispersion comprises an inorganic pigment having a 50%-volume-average particle size of 0.10 to 5.00 μm.

A eighth aspect of the invention is the heat-sensitive recording material (S), wherein the water-insoluble dispersion comprises an inorganic pigment having a 50%-volume-average particle size of 0.10 to 5.00 μm and the inorganic pigment is selected from the group consisting of calcium carbonate, titanium oxide, kaolin, aluminum hydroxide, amorphous silica, and zinc oxide.

A ninth aspect of the invention is the heat-sensitive recording material (S), wherein the water-insoluble dispersion comprises an inorganic pigment having a 50%-volume-average particle size of 0.10 to 5.00 μm and the inorganic pigment is coated with at least one selected from the group consisting of higher fatty acids, metal salts of higher fatty acids, and higher alcohols.

A tenth aspect of the invention is the heat-sensitive recording material (S), wherein the water-insoluble dispersion comprises a surface gloss adjusting agent.

An eleventh aspect of the invention is the heat-sensitive recording material (S), wherein the water-insoluble dispersion comprises a matting agent.

A twelfth aspect of the invention is the heat-sensitive recording material (S), wherein the water-insoluble organic material comprises a lubricant which has a melting point of 160° C. or less, and is in solid form at ordinary temperature.

A thirteenth aspect of the invention is the heat-sensitive recording material (S), wherein the water-insoluble organic material comprises a lubricant which is in liquid form at ordinary temperature and the lubricant is selected from the group consisting of silicone oil, liquid paraffin and lanolin.

A fourteenth aspect of the invention is the heat-sensitive recording material (S), wherein the water-insoluble organic material has an average particle diameter of 0.1 to 5.0 μm.

A fifteenth aspect of the invention is the heat-sensitive recording material (S), wherein the protective layer further comprises a binder selected from the group consisting of polyvinyl alcohol, carboxy-modified polyvinyl alcohol, and silica-modified polyvinyl alcohol.

A sixteenth aspect of the invention is the heat-sensitive recording material (S), wherein the dry coated amount of the protective layer is from 0.2 to 7 g/m$^2$.

A seventeenth aspect of the invention is the heat-sensitive recording material (S), wherein the support is a polymer film.

An eighteenth aspect of the invention is the heat-sensitive recording material (S), wherein all of the layers are simultaneously formed by multi-layer coating with an extruding die.

A nineteenth aspect of the invention is the heat-sensitive recording material (S), wherein all of the layers are simultaneously formed by multi-layer coating with an extruding die and the coating speed of the layers in the multi-layer coating is 100 m/min or more.

DETAILED DESCRIPTION OF THE INVENTION

The heat-sensitive recording material of the present invention will be described in detail hereinafter.

The heat-sensitive recording material of the invention is a heat-sensitive recording material comprising, on a support, at least a heat-sensitive recording layer and a protective layer in this order, wherein the protective layer includes an acetylene glycol derivative represented by the following formula (1) in an amount of 2% or more by mass of solid content in the protective layer, the protective layer includes a water-insoluble dispersion in an amount of 5% or more by mass of the solid content in the protective layer, and the protective layer includes a water-insoluble organic material in a form of emulsion in an amount of 5% or more by mass of the solid content in the protective layer:

Formula (1)

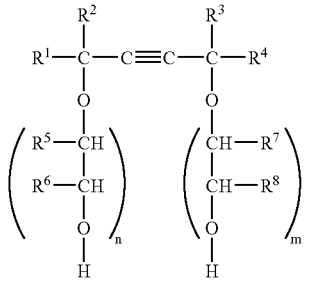

wherein $R^1$ to $R^4$ each independently represent a hydrogen atom, a branched, linear or cyclic substituted or unsubstituted alkyl group having 1 to 8 carbon atoms, or a substituted or unsubstituted aryl group having 6 to 10 carbon atoms, $R^5$ to $R^8$ each independently represent a hydrogen atom or a methyl group, and n and m each independently represent an integer of 0 to 50. If necessary, the heat-sensitive recording material may comprise another layer.

Protective Layer

First, the protective layer is described in detail. The protective layer is provided on the heat-sensitive recording layer. Alternatively, when an intermediate layer is provided as another layer on the heat-sensitive recording layer, the protective layer is provided on the intermediate layer.

The protective layer is formed by applying a coating solution for forming protective layer. The protective layer includes an acetylene glycol derivative represented by the formula (1) in an amount of 2% or more by mass of solid content in the protective layer, includes a water-insoluble dispersion in an amount of 5% or more by mass of the solid content in the protective layer, and includes a water-insoluble organic material in a form of an emulsion in an amount of 5% or more by mass of the solid content in the protective layer.

Acetylene Glycol Derivative

The acetylene glycol derivative represented by the formula (1) is explained.

In the formula (1), $R^1$ to $R^4$ each independently represent a hydrogen atom, a branched, linear or cyclic substituted or unsubstituted alkyl group having 1 to 8 carbon atoms, or a substituted or unsubstituted aryl group having 6 to 10 carbon atoms, $R^5$ to $R^8$ each independently represent a hydrogen atom or a methyl group, and n and m each independently represent an integer of 0 to 50.

In the formula (1), n and m each independently represent an integer of 0 to 50, and the sum of n and m is preferably 6 or less. Most preferably, each of n and m is zero.

$R^1$ to $R^4$ each independently represent a hydrogen atom, a branched, linear or cyclic substituted or unsubstituted alkyl group having 1 to 8 carbon atoms, or a substituted or unsubstituted aryl group having 6 to 10 carbon atoms. Specific examples of the alkyl group include a methyl group, an ethyl group, an n-propyl group, an isopropyl group, an n-butyl group, an isobutyl group, and a cyclohexyl group. Specific examples of the aryl group include a phenyl and a naphthyl groups. Examples of the substituent include an ether group and an ester group.

It is particularly preferable that $R^2$ and $R^3$ should be methyl groups, $R^1$ and $R^4$ should be isobutyl groups, and n and m should be each zero.

The protective layer in the invention includes the acetylene glycol derivative represented by the formula (1) in an amount of 2% or more by mass, preferably 2% to 12% (inclusive) by mass, and more preferably 2 to 8% (inclusive) by mass of solid content in the protective layer. If the content of the acetylene glycol derivative represented by the formula (1) is less than 2% by mass of the solid content in the protective layer, surface deficiency occurs.

Specific examples of the acetylene glycol derivative represented by the formula (1) are shown below. In the invention, however, the derivative is not limited to these examples.

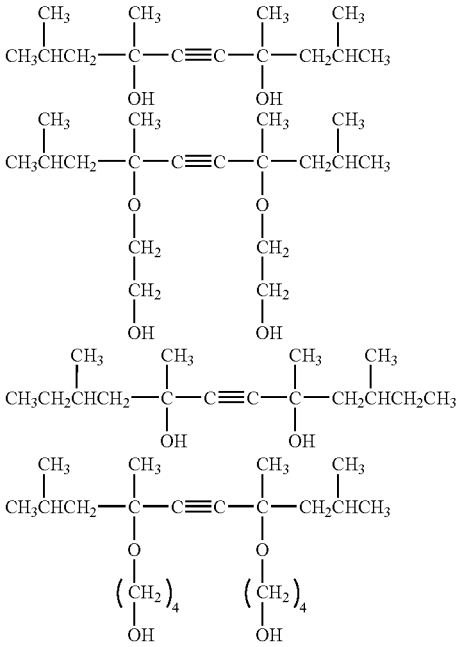

-continued

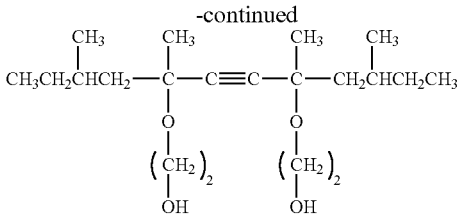

Water-insoluble Dispersion

The protective layer in the invention includes, in a form of a dispersion, water-insoluble particles of an inorganic pigment added to prevent head gas adhesion or prevent sticking (i.e., melting and adhering), a surface gloss adjusting agent, a matting agent or the like, the dispersion being referred to as the "water-insoluble dispersion" hereinafter on occasion.

The term "prevent sticking" refers to preventing: sticking of a thermal head to a heat-sensitive recording material at the time of heat-sensitive recording; adhesion of record dregs to the thermal head; and occurrence of abnormal sound.

The average particle diameter of the inorganic pigment used in the protective layer is preferably from 0.10 to 5.00 μm, wherein the "average particle diameter" refers to the 50%-volume average particle diameter measured by the laser diffraction method (that is, the particle diameter at which the cumulative volume distribution of the particles reaches 50%, this diameter being measured with a laser diffraction particle size distribution meter (trade name: LA700, manufactured by Horiba Ltd.) and being referred to merely as the "average particle diameter" on occasion hereinafter). The 50%-volume average particle size is preferably from 0.20 to 0.50 μm in order that at the time of recording the heat-sensitive recording material with a thermal head, the occurrence of sticking between the head and the heat-sensitive recording material, abnormal sound, and the like should be prevented.

When this 50%-volume average particle size is within a range of 0.10 to 5.00 μm, the effect of reducing the abrasion of the thermal head is large and the effect of preventing melting adhesion between the thermal head and the binder in the protective layer is also large. As a result, the so-called sticking, that is, adhesion between the thermal head and the protective layer of the heat-sensitive recording material at the time of printing can be effectively prevented.

The kind of the inorganic pigment contained in the protective layer is not particularly limited, and may be any known inorganic pigment. Particularly preferable examples thereof include calcium carbonate, titanium oxide, kaolin, aluminum hydroxide, amorphous silica, and zinc oxide. Among these pigments, calcium carbonate and aluminum hydroxide are more preferable. These pigments may be used alone or in combination of two or more thereof.

The surface of the pigment may be coated with at least one selected from the group consisting of a higher fatty acids, a metal salts of a higher fatty acids, and higher alcohols.

Examples of the higher fatty acid include stearic acid, palmitic acid, myristic acid and lauric acid. Stearic acid is preferred.

The inorganic pigment is preferably used after the pigment is dispersed so as to have a 50%-volume average particle size of 0.10 to 5.00 μm. The dispersing is preferably conducted by a known dispersing machine such as a dissolver, a sand mill or a ball mill in the presence of at least one dispersing auxiliary selected from sodium hexametaphosphorate, partially or completely saponified modified polyvinyl alcohols, polyacrylic acid copolymers and surfactants (preferably selected from partially or completely saponified modified polyvinyl alcohols and ammonium salts of polyacrylic acid copolymers).

As the surface gloss adjusting agent included in the protective layer, starch particles or the like are used.

Examples of the matting agent included in the protective layer include fine particles of starch obtained from barley, wheat, corn, rice or pea; fine particles of synthetic polymers such as cellulose fibers, polystyrene resins, epoxy resins, polyurethane resins, urea formalin resins, poly(meth)acrylate resins, polymethyl(meth)acrylate resins, copolymer resins comprising vinyl chloride and/or vinyl acetate, and polyolefins; and fine particles of inorganic materials such as calcium carbonate, titanium oxide, kaolin, smectite clay, aluminum hydroxide, silica and zinc oxide. In order to obtain a heat-sensitive recording material having an excellent transparency, material in the form of fine particles having a refractive index of 1.45 to 1.75 is preferable. The average particle size thereof is preferably from 1 to 20 μm, more preferably from 1 to 10 μm.

The matting agent is used in a form of a dispersion as in the case of the inorganic pigment.

In the heat-sensitive recording material of the invention, the protective layer contains the water-insoluble dispersion in an amount of 5% or more by mass of the solid content in the protective layer, preferably 10 to 70% (inclusive) by mass thereof, more preferably 20 to 40% (inclusive) by mass thereof. If the content of the water-insoluble dispersion in the solid content in the protective layer is less than 5% by mass, the effects of the water-insoluble dispersion in the invention, that is, the prevention of head gas adhesion, the prevention of the sticking, and the gloss adjustment of the surface are not exhibited.

[Water-insoluble Organic Material]

The protective layer in the invention further contains a water-insoluble organic material, such as a releasing agent, a lubricant or a slipping agent in a form of an emulsion in order to keep its good head matching property over a wide printing energy range.

A single kind of a water-insoluble organic material which takes a solid form or a liquid form at ordinary temperature may be used in the invention as the water-insoluble organic material. Alternatively, two or more kinds of water-insoluble organic materials each of which takes a solid form or a liquid form at ordinary temperature may be used in the invention as the water-insoluble organic materials. The melting point of the lubricant which takes a solid form at ordinary temperature is preferably 160° C. or less, more preferably 140° C. or less. Specific examples of the lubricant include stearic amide (melting point: 100° C.), methylolstearic amide (melting point: 101° C.), polyethylene wax (melting point: 110° C.), paraffin wax (melting point: 50 to 90° C.), glycerin tri-12-hydroxystearate (melting point: 88° C.), oleic amide (melting point: 73° C.), zinc oleate (melting point: 75° C.), lauric amide (melting point: 84° C.), aluminum stearate (melting point: 102° C.), manganese stearate (melting point: 112° C.), zinc stearate (melting point: 125° C.), calcium stearate (melting point: 160° C.), ethylenebisstearamide (melting point: 140° C.), magnesium stearate (melting point: 132° C.), magnesium palmitate (melting point: 122° C.), magnesium myristate (melting point: 131° C.), polyoxyethylene alkyl ether phosphate (melting point: 35° C.), and amide compounds represented by the Structural formulae (1) to (3):

Structural formula (1)

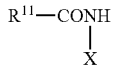

Structural formula (2)

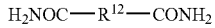

Structural formula (3)

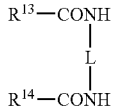

wherein in the Structural formulae (1) through (3), X represents H or $CH_2OH$, $R^{11}$, $R^{12}$, $R^{13}$ and $R^{14}$ each independently represent a saturated or unsaturated alkyl group which has 8 to 24 carbon atoms and may be branched or substituted by a hydroxyl group; and $R^{13}$ and $R^{14}$ may be the same or different. L is represented by the following structural form (4):

Structural formula (4)

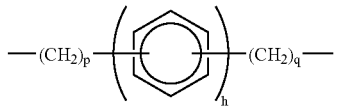

wherein p+q=0 to 8.

Among these examples, the following are preferable from the viewpoints of the transportation torque of the recording material, recording sound, and the prevention of the sticking: an appropriate combination of at least one of zinc stearate, stearic amide, stearic acid, glycerin tri-12-hydroxystearate and polyoxyethylene alkyl ether phosphate represented by the following formula (A):

Formula (A)

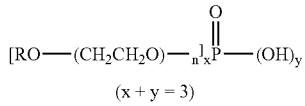

In the above formula (A), R represents and alkyl group which may have a substituent. N represents an integer selected from 2 to 20.

Among the above-mentioned examples, compounds represented by the structural formula (1) or (3) are particularly preferable. Each of $R^{11}$, $R^{13}$ and $R^{14}$ is preferably a saturated or unsaturated alkyl group having 12 to 20 carbon atoms. The alkyl group may be branched and may have a hydroxyl group in a structure thereof. When h is 0, p+q is preferably from 0 to 4, more preferably 2. When h is 1, p+q is preferably from 0 to 2.

Examples of the lubricant which takes a liquid form at ordinary temperature include silicone oil, liquid paraffin, and lanolin. Among these examples, silicone oil is preferable. As the silicone oil, silicon oil having a viscosity of 200 to 100,000 cps at ordinary temperature is preferable. The silicone oil may be modified with at least one of a carboxyl group, a polyoxyethylene group, an amino group, and the like.

The water-insoluble organic material in the invention is dissolved in a solvent (preferably an organic solvent) and then emulsified by a known emulsifier such as a homogenizer, a dissolver, or a colloid mill in the presence of a dispersing agent such as a water-soluble polymer or a surfactant. The organic material is then used in the form of the emulsion.

This emulsion may be an emulsion obtained by self-emulsifying the material in liquid form at ordinary temperature; an emulsion obtained by using a solvent to emulsify the material, and subsequently removing the solvent from the emulsion; or an emulsion obtained by high-temperature high-pressure emulsification without organic solvent. Thus, the method of the emulsification is not particularly limited.

The average particle diameter of the emulsion is preferably from 0.1 to 5.0 μm, more preferably from 0.1 to 2 μm. The average particle size referred to herein is a 50%-weight average particle diameter measured with a laser diffraction particle size distribution meter (trade name: LA700, manufactured by Horiba Ltd.) at a transmission factor of 75±1%.

In the heat-sensitive recording material of the invention, the protective layer contains, in a form of an emulsion, the water-insoluble organic material in an amount of 5% or more by mass of the solid content in the protective layer, preferably in an amount of 7 to 40% (inclusive) by mass of the solid content in the protective layer, more preferably in an amount of 10 to 30% (inclusive) by mass of the solid content in the protective layer.

If the content of the water-insoluble organic material is less than 5% by mass of the solid content in the protective layer, the effects of the prevention of head gas adhesion and the sticking (melting and adhering) are not exhibited.

When the protective layer includes the water-insoluble organic material, surface deficiency easily occurs. However, by adding the acetylene glycol derivative represented by the formula (1) to the protective layer, it is possible to prevent the occurrence of surface deficiency effectively.

The binder included in the protective layer is preferably polyvinyl alcohol, carboxyl-modified polyvinyl alcohol, silica-modified polyvinyl alcohol, or the like from the viewpoint of securing the transparency of the protective layer.

The protective layer may contain a known hardening agent.

In order to form the protective layer on the heat-sensitive recording layer (or on the intermediate layer) uniformly, it is preferable to add a surfactant to a coating solution for forming protective layer. Examples of the surfactant include alkali metal salts of sulfosuccinic acid or derivatives thereof, and fluorine-type surfactants. Specific examples thereof include a sodium or ammonium salt of di-(2-ethylhexyl) sulfosuccinic acid or di-(n-hexyl)sulfosuccinic acid.

The protective layer may contain at least one of surfactants, metal oxide fine particles, inorganic electrolytes, polymer electrolytes, and the like in order to prevent the electrification of the heat-sensitive recording material.

The protective layer may have a monolayer structure or a multilayer structure having two or more layers. The dry amount of the applied protective layer is preferably from 0.2 to 7 g/m$^2$, more preferably from 1 to 4 g/m$^2$.

Heat-sensitive Recording Layer

The heat-sensitive recording layer comprises at least a coloring component, and may comprise other components if necessary.

Coloring Component

The heat-sensitive recording layer may be a layer having any composition if this layer has excellent transparency before being treated and exhibits a color by heat.

An example of such a heat-sensitive recording layer is the so-called two-component type heat-sensitive recording layer, which comprises a substantially colorless coloring component A and a substantially colorless coloring component B which reacts with the coloring component A to develop a color. The coloring components A and B are each preferably capsulated in microcapsules. Examples of the combination of the two components which constitute this two-component type heat-sensitive recording layer include the following (a) to (m):

(a) a combination of an electron-donating dye precursor and an electron-accepting compound;
(b) a combination of a photolytic diazo compound and a coupler;
(c) a combination of a metal salt of an organic acid such as silver behenate or silver stearate and a reducing agent such as protocathechinic acid, spiroindane or hydroquinone;
(d) a combination of a salt of a long-chain fatty acid such as a ferric salt of stearic acid or a ferric salt of myristic acid and a phenol such as gallic acid or ammonium salicylate;
(e) a combination of a heavy metal salt of an organic acid such as a nickel, cobalt, lead, copper, iron, mercury or silver salt of acetic acid, stearic acid or palmitic acid and an alkali earth metal sulfide such as calcium sulfide, strontium sulfide or potassium sulfide, or a combination of such a heavy metal salt of organic acid and an organic chelate agent such as s-diphenylcarbazide or diphenylcarbazone;
(f) a combination of a (heavy) metal sulfide such as silver sulfide, lead sulfide, mercury sulfide or sodium sulfide and a sulfur compound such as Na-tetrathionate, sodium thiosulfate, or thiourea;
(g) a combination of a ferric salt of a fatty acid such as a ferric salt of stearic acid and an aromatic polyhydroxy compound such as 3,4-dihydroxytetraphenylmethane;
(h) a combination of a noble metal salt of an organic acid such as silver oxalate or mercury oxalate and an organic polyhydroxy compound such as polyhydroxyalcohol, glycerin or glycol;
(i) a combination of a ferric salt of a fatty acid such as a ferric salt of pelargonic acid or a ferric salt of lauric acid and a thiocetylcarbamide or isothiocetylcarbamide derivative;
(j) a combination of a lead salt an organic acid such as lead caprate, lead pelargonate, or lead behenate and a thiourea derivative such as ethylenethiourea or N-dodecylthiourea;
(k) a combination of a heavy metal salt of a higher fatty acid such as a ferric salt of stearic acid or copper stearate and zinc dialkyldithiocarbamate;
(l) a combination forming an oxazine dye, such as a combination of resorcin and a nitroso compound; and
(m) a combination of a formazan compound and (a reducing agent and/or a metal salt).

Among these combinations, the following are preferable: (a) the combination of an electron-donating dye precursor and an electron-accepting compound, (b) the combination of a photolytic diazo compound and a coupler, or (c) the combination of a metal salt of an organic acid and a reducing agent. The combination (a) or (b) is more preferable.

By forming a heat-sensitive recording layer so that the heat-sensitive layer has a low haze value (%) (calculated from the equation [(diffused transmittance/all-light transmittance)×100]), the heat-sensitive recording material of the invention can form an image excellent in transparency. This haze value is an index representing the transparency of material, and is generally calculated from all-light transmission light amount, diffused transmission light amount, and parallel transmission light amount, using a haze meter.

Examples of the method of decreasing the haze value according to the invention include a method of allowing the coloring components A and B in the heat-sensitive recording layer to each have the 50%-volume average particle diameter of 1.0 μm or less, preferably 0.6 μm or less and allowing a binder in the heat-sensitive recording layer to occupy 30 to 60% by mass of the entire solid content in the heat-sensitive layer; a method of microencapsulating one of the coloring components A and B and allowing the other one to be present in a form of a substantially continuous layer, for example, in a form of something like an emulsion (such as an emulsified dispersion) after application and drying thereof. A method of bring the refractive indexes of the components used in the heat-sensitive recording layer close to a given value as much as possible is also effective.

As described in the foregoing, in the specification, the 50%-volume average particle diameter refers to the particle diameter at which the cumulative volume distribution of the particles reaches 50%, this diameter being measured with a laser diffraction particle size distribution meter (trade name: LA700, manufactured by Horiba Ltd.) and being referred to merely as the "average particle diameter" on occasion hereinafter).

The following will describe the above-mentioned combination (a), (b) and (c), which are preferably used in the heat-sensitive recording layer, in detail hereinafter. Combination (a) of an electron-donating dye precursor and an electron-accepting compound The electron-donating dye precursor which is preferably used in the invention is any electron-donating dye precursor that is substantially colorless. The precursor has a nature of donating an electron to develop a color or accepting a proton from an acid to develop a color, and is preferably a colorless compound having a partial skeleton of lactone, lactam, sultone, spiropyran, ester, amide or the like, the skeleton being opened or cleaved when the compound contacts with an electron-accepting compound.

Examples of the electron-donating dye precursor include triphenylmethanephthalide compounds, fluorane compounds, phenothiazine compounds, indolylphthalide compounds, leuco auramine compounds, rohdamine lactam compounds, triphenylmethane compounds, triazene compounds, spiropyran compounds, fluorene compounds, pyridine compounds and pyrazine compounds.

Specific examples of the phthalide compounds include compounds described in U.S. Reissued Pat. No. 23,024, and U.S. Pat. Nos. 3,491,111, 3,491,112, 3,491,116, and 3,509,174.

Specific examples of the fluorane compounds include compounds described in U.S. Pat. Nos. 3,624,107, 3,627,787, 3,641,011, 3,462,828, 3,681,390, 3,920,510, and 3,959,571.

Specific examples of the spiropyran compounds include compounds described in U.S. Pat. No. 3,971,808.

Specific examples of the pyridine compounds and the pyrazine compounds include compounds described in U.S. Pat. Nos. 3,775,424, 3,853,869 and 4,246,318.

Specific examples of the fluorene compounds include compounds described in JP-A No 63-094878.

Among these compounds, a particularly preferable example is 2-arylamino-3-[H, halogen, alkyl or alkoxy-6-substituted aminofluorane], which develops black color.

Specific examples thereof include 2-anilino-3-methyl-6-diethylaminofluorane, 2-anilino-3-methyl-6-N-cyclohexyl-N-methylaminofluorane, 2-p-chloroanilino-3-methyl-6-dibutylaminofluorane, 2-anilino-3-methyl-6-dioctylaminofluorane, 2-anilino-3-chloro-6-diethylaminofluorane, 2-anilino-3-methyl-6-N-ethyl-N-isoamylaminofluorane, 2-anilino-3-methyl-6-N-ethyl-N-dodecylaminofluorane, 2-anilino-3-methoxy-6-dibutylaminofluorane, 2-o-chloroanilino-6-dibutylaminofluorane, 2-p-chloroanilino-3-ethyl-6-N-ethyl-N-isoamylaminofluorane, 2-o-chloroanilino-6-p-butylanilinofluorane, 2-anilino-3-pentadecyl-6-diethylaminofluorane, 2-anilino-3-ethyl-6-dibutylaminofluorane, 2-o-toluidino-3-methyl-6-diisopropylaminofluorane, 2-anilino-3-methyl-6-N-isobutyl-N-ethylaminofluorane, 2-anilino-3-methyl-6-N-ethyl-N-tetrahydrofurfurylaminofluorane, 2-anilino-3-chloro-6-N-ethyl-N-isoamylaminofluorane, 2-anilino-3-methyl-6-N-methyl-N-γ-ethoxypropylaminofluorane, 2-anilino-3-methyl-6-N-ethyl-N-γ-ethoxypropylaminofluorane, and 2-anilino-3-methyl-6-N-ethyl-N-γ-propoxypropylaminofluorane.

Examples of the electron-accepting compound which reacts with the electron-donating dye precursor include acidic compounds such as phenol compounds, organic acids or metal salts thereof, and oxybenzoic esters. Compounds described in JP-A No. 61-291183 are specific examples thereof.

More specific examples thereof include bisphenol compounds such as 2,2-bis(4'-hydroxyphenyl)propane [common name: bisphenol A], 2,2-bis(4'-hydroxyphenyl)pentane, 2,2-bis(4'-hydroxy-3',5'-dichlorophenyl)propane, 1,1-bis(4'-hydroxyphenyl)cyclohexane, 2,2-bis(4'-hydroxyphenyl) hexane, 1,1-bis(4'-hydroxyphenyl)propane, 1,1-bis(4'-hydroxyphenyl)butane, 1,1-bis(4'-hydroxyphenyl)pentane, 1,1-bis(4'-hydroxyphenyl)hexane, 1,1-bis(4'-hydroxyphenyl)heptane, 1,1-bis(4'-hydroxyphenyl)octane, 1,1-bis(4'-hydroxyphenyl)-2-methyl-pentane, 1,1-bis(4'-hydroxyphenyl)-2-ethyl-hexane, 1,1-bis(4'-hydroxyphenyl)dodecane, 1,4-bis(p-hydroxyphenylcumyl)benzene, 1,3-bis(p-hydroxyphenylcumyl)benzene, bis(p-hydroxyphenyl)sulfone, bis(3-allyl-4-hydroxyphenyl)sulfone, and bis(p-hydroxyphenyl) benzyl acetate ester;

salicylic acid derivatives such as 3,5-di-α-methylbenzylsalicylic acid, 3,5-di-tert-butylsalicylic acid, 3-α-α-dimethylbenzylsalicylic acid, and 4-(β-p-methoxyphenoxyethoxy) salicylic acid;

polyvalent metal salts of the salicylic acid derivatives (preferably, zinc and aluminum salts of the salicylic acid derivatives);

oxybenzoic esters such as benzyl p-hydroxybenzoate, 2-ethylhexyl p-hydroxybenzoate, and β-resorcylic acid-(2-phenoxyethyl) ester; and phenols such as p-phenylphenol, 3,5-diphenylphenol, cumylphenol, 4-hydroxy-4'-isopropoxy-diphenylsulfone, and 4-hydroxy-4'-phenoxy-diphenylsulfone.

The bisphenol compounds are particularly preferable since they give a satisfactory color developing property.

A single kind of the electron-accepting compound may be used or a multiple kinds of the electron-accepting compounds may be simultaneously used.

Combination (b) of a Photolytic Diazo Compound and a Coupler

The photolytic diazo compound is a compound which couples with a coupler, which is a coupling component that will be detailed later, so as to develop a desired color, and has a photolytic property so that the compound decomposes upon receiving light having a specific wavelength before the reaction whereby the compound loses color-developing ability any longer even in the presence of the coupling component.

The color hue by this color-developing system is determined by the diazo dye generated by the reaction between the diazo compound and the coupler. Accordingly, by changing the chemical structure of the diazo compound or the coupler, the color hue can be changed easily. Arbitrary color hue can be obtained by appropriate selection of the combination.

A photolytic diazo compound preferably used in the invention is an aromatic diazo compound, specific examples of which include aromatic diazonium salts, diazosulfonate compounds and diazoamino compounds.

Examples of the aromatic diazonium salts include the compounds represented by:

$$Ar—N_2^+.X_-$$

wherein Ar represents a substituted or unsubstituted aromatic hydrocarbon cyclic group, $N_2^+$ represents a diazonium group, and $X_-$ represents an acid anion. The aromatic diazonium salts are not limited to the examples. Preferably, an aromatic diazonium salt that is used should have excellent photo-fixability, should suppress occurrence of colored stain after being fixed, and should provide image whose colored portions are stable.

A number of diazosulfonate compounds have been known in recent years. The compounds are obtained by treating various diazonium salts with sulfite, and can be preferably used in the heat-sensitive recording materials of the invention.

The diazoamino compounds can be obtained by coupling a diazo group with dicyan diamide, sorcosine, methyltaurine, N-ethylanthranic acid-5-sulfonic acid, monoethanolamine, diethanolamine, guanidine, or the like, and can be preferably used in the heat-sensitive recording materials of the invention.

Details of these diazo compounds are described, for example, in JP-A No. 2-136286.

Examples of the coupler which couples with the above-mentioned diazo compound include 2-hydroxy-3-naphthoic acid anilide, resorcin, and the compounds described in JP-A No. 62-146678.

If the above-mentioned combination of a diazo compound and a coupler is used in the heat-sensitive recording layer, a basic substance as a sensitizer may be included in the heat-sensitive layer, since the coupling reaction between the diazo compound can be further promoted if the reaction is conducted in a basic environment.

Examples of the basic substance include water-insoluble or scarcely water-soluble basic materials and materials which generate alkali by heat. Examples thereof include nitrogen-containing compounds such as inorganic or organic ammonium salts, organic amines, amides, urea and thiourea or derivatives thereof, thiazoles, pyrroles, pyrimidines, pyperazines, guanidines, indoles, imidazoles, imidazolines, triazoles, morpholines, piperidines, amidines, formazines, and pyridines.

The basic substances described in JP-A No. 61-291183 can be cited as specific examples.

Combination (c) of an Organic Metal Salt and a Reducing Agent

Specific examples of the organic metal salt include silver salts of long-chain aliphatic carboxylic acids, such as silver laurate, silver myristate, silver palmitate, silver stearate, silver arachate, and silver behenate; silver salts of organic compounds each having an imino group, such as benzotriazole silver salts, benzimidazole silver salts, carbazole silver salts and phthalazinone silver salts; silver salts of sulfur-containing compounds, such as s-alkylthioglycolate; silver salts of aromatic carboxylic acids, such as silver benzoate and silver phthalate; silver salts of sulfonic acids, such as silver ethansulfonate; silver salts of sulfinic acids, such as silver o-toluenesulfinate; silver salts of phosphoric acid, such as silver phenylphosphate; silver baribiturate, silver saccharate, and silver salts of salicylasdoxime; and mixtures thereof.

Among these examples, silver salts of long-chain aliphatic carboxylic acids are preferable. In particular, silver behenate is more preferable. Behenic acid may be used together with silver behenate.

As the reducing agent, one or more selected from the compounds described in JP-A No. 53-1020, page 227, lower-left column, line 14 to page 229, upper-right column, line 11 can be appropriately used. In particular, the following can be preferably used: mono-, bis-, tris- or tetrakis-phenols, mono- or bis-naphthols, di- or poly-hydroxynaphthalenes, di- or poly-hydroxybenzenes, hydroxy monoethers, ascorbic acids, 3-pyrazolidones, pyrazolines, pyrazolones, reducing sugars, phenylenediamines, hydroxylamines, reductones, hydroxamines, hydrazides, amideoximes, and N-hydroxyureas.

Among these examples, aromatic organic reducing agents such as polyphenols, sulfonamidephenols, and naphthols are more preferable.

In order to keep the transparency of the heat-sensitive recording material sufficiently, it is preferable that the heat-sensitive recording layer should include the combination (a) of an electron-donating dye precursor and an electron-accepting compound, or the combination (b) of a photolytic diazo compound and a coupler. It is also preferable in the invention to microencapsulate any one of the coloring components A and B and use the microcapsules. It is more preferable to microencapsulate the electron-donating dye precursor or the photolytic diazo compound and use the microcapsules.

Microcapsules

The process for producing the microcapsules will be described in detail hereinafter.

The interfacial polymerization method, the internal polymerization method, and the external polymerization method are known as methods for producing microcapsules. Any one thereof may be employed.

As described above, it is preferable in preparation of the heat-sensitive recording material of the invention to microencapsulate the electron-donating dye precursor or the photolytic diazo compound. It is particularly preferable to employ the interfacial polymerization method, which comprises the step of mixing an oil phase prepared by dissolving or dispersing the electron-donating dye precursor or the photolytic diazo compound, which will be cores of capsules, in a hydrophobic organic solvent with a water phase comprising a dissolved water-soluble polymerizable substance, the step of emulsifying the mixture by means of a homogenizer or the like, and the step of heating the emulsion to cause polymerization at the interface between the oil droplets and water, thereby forming microcapsule walls made of the resultant polymer.

The reactants for making the polymer material are added to the inside and/or the outside of the oil droplets. Specific examples of the polymer include polyurethane, polyurea, polyamide, polyester, polycarbonate, urea-formaldehyde resin, melamine resin, polystyrene, and styrene-methacrylate copolymer, styrene-acrylate copolymer. Among these polymers, polyurethane, polyurea, polyamide, polyester, and polycarbonate are preferable. Polyurethane and polyurea are more preferable.

For example, if polyurea is used for the material of the capsule walls, microcapsule walls can easily be formed by causing polyisocyanate such as diisocyanate, triisocyanate, tetraisocyanate or polyisocyanate prepolymer to react with a polyamine such as diamine, triamine or tetraamine, a prepolymer having 2 or more amino groups, piperazine or a derivative thereof, or a polyol in the above-mentioned water phase by the interfacial polymerization method.

For example, composite walls composed of polyurea and polyamide, or composite walls composed of polyurethane and polyamide can be prepared by incorporating polyisocyanate and a second material which reacts with the polyisocyanate to form capsule walls (for example, acid chloride, polyamine or polyol) into an aqueous solution (water phase) of a water-soluble polymerizable substance or an oil medium (oil phase) to be capsulated, emulsifying the mixture, and heating the resultant emulsion. Details of this method of producing the composite walls made of polyurea and polyamide are described in JP-A No. 58-66948.

The polyisocyanate compound is preferably a compound having three or more functional isocyanate groups. A bi-functional isocyanate compound may be used together.

Specific examples of the polyisocyanate compound include a diisocyanate (such as xylene diisocyanate or a hydrogenated product thereof, hexamethylene diisocyanate, tolylene diisocyanate or a hydrogenated product thereof, or isophorone diisocyanate) as a main raw material; dimers or trimers thereof (biurets or isocyanurates); polyfunctional adducts of polyols (such as trimethylolpropane) with bi-functional isocyanates (such as xylylene diisocyanate); compounds obtained by introducing high molecular-weight compound (for example, a polyether having active hydrogen atoms, such as polyethylene oxide) into adducts of polyols (such as trimethylolpropane) with bi-functional isocyanates (such as xylylene diisocyanate); and condensates of benzene isocyanate with formalin.

The compounds described in JP-A Nos. 62-212190 and 4-26189, 5-817694 and 10-114153 are preferable.

The polyisocyanate is preferably added so that the average particle size of the microcapsules will be from 0.3 to 12 μm and the thickness of the capsule walls thereof will be from 0.01 to 0.3 μm. The size of the dispersed particle is generally from about 0.2 to 10 μm.

Specific examples of the polyol and/or the polyamine, which reacts with the polyisocyanate and is added as one of the components of the microcapsule wall to the water phase and/or the oil phase, include propylene glycol, glycerin, trimethylolpropane, triethanloamine, sorbitol, and hexamethylenediamine. When the polyol is added thereto, polyurethane walls are formed. In the above-mentioned reaction, it is preferable to keep the reaction temperature high or add an appropriate polymerization catalyst in order to increase the reaction velocity.

The polyisocyanate, the polyol, the reaction catalyst or the polyamide for forming a part of capsule walls, and the like are described in detail in published books (see, for example, *Polyurethane Handbook*, edited by Keiji Iwata and published in the Nikkan Kogyo Shimbun, Ltd. (1987)).

If necessary, a charge adjusting agent such as a metal-containing dye or nigrosin, or any other additive may be added to the microcapsule walls. These additives can be added at the time of forming the walls, or at any other time, to be incorporated in the walls of the capsules. If necessary, a monomer such as a vinyl monomer may be graft-polymerized in order to adjust the charging property of the surfaces of the capsule walls.

In order to make the microcapsule walls having excellent substance-permeability and color-developability even at lower temperatures, it is preferable to use a plasticizer suitable for the polymer used as the wall material. The plasticizer has a melting point of preferably 50° C. or more, more preferably 120° C. or less. It is particularly preferable to select a plasticizer which has such a melting point and takes a solid form at ordinary temperature.

For example, when the wall material is polyurea or polyurethane, it is preferable to use a hydroxy compound, a carbamic ester compound, an aromatic alkoxy compound, an organic sulfonamide compound, an aliphatic amide compound, an arylamide compound or the like.

When the above-mentioned oil phase is prepared, it is preferable to use an organic solvent having a boiling point of 100 to 300° C. as a hydrophobic organic solvent in which the electron-donating dye precursor or the photolytic diazo compound dissolves before cores of microcapsules are formed.

Specific examples thereof include esters, dimethylnaphthalene, diethylnaphthalene, diisopropylnaphthalene, dimethylbiphenyl, diisopropylbiphenyl, diisobutylbiphenyl, 1-methyl-1-dimethylphenyl-2-phenylmethane, 1-ethyl-1-dimethylphenyl-1-phenylethane, 1-propyl-1-dimethylphenyl-1-phenylethane, triallylmethane (such as tritoluylmethane and toluyldiphenylmethane), terphenyl compounds (such as terphenyl), alkyl compounds, alkylated diphenyl ether compounds (such as propyldiphenyl ether), hydrogenated terphenyl compounds (such as hexahydroterphenyl), and diphenyl ether. Among these examples, esters are particularly preferable from the viewpoints of the emulsification stability of the emulsion.

Examples of the esters include phosphate esters such as triphenyl phosphate, tricresyl phosphate, butyl phosphate, octyl phosphate and cresylphenyl phosphate; phthalic esters such as dibutyl phthalate, 2-ethylhexyl phthalate, ethyl phthalate, octyl phthalate, and butylbenzyl phthalate; dioctyl tetrahydrophthalate; benzoic esters such as ethyl benzoate, propyl benzoate, butyl benzoate, isopentyl benzoate, and benzyl benzoate; abietic esters such as ethyl abietate, and benzyl abietate; dioctyl adipate; isodecyl succinate; diocyl azelate; oxalic esters such as dibutyl oxalate and dipentyl oxalate; diethyl malonate; maleic esters such as dimethyl maleate, diethyl maleate, and dibutyl maleate; tributyl citrate; sorbic esters such as methyl sorbate, ethyl sorbate and butyl sorbate; sebacic esters such as dibutyl sebacate, and dioctyl sebacate; ethylene glycol esters such as formic monoester and diester, butyric monoester and diester, lauric monoester and diester, palmitic monoester and diester, stearic monoester and diester, and oleic monoester and diester; triacetin; diethyl carbonate; diphenyl carbonate; ethylene carbonate; propylene carbonate; boric esters such as tributyl borate and tripentyl borate.

Among them, it is preferable to use, as the organic solvent, tricresyl phosphate alone or in combination with other solvent(s) since the stability of the emulsion becomes most satisfactory. The above-mentioned oils may be used in any combination thereof, or the ester oil(s) may be used together with an oil other than the above-mentioned oils.

If the solubility of the electron-donating dye precursor or the photolytic diazo compound, which is to be capsulated, in the hydrophobic organic solvent is low, a low boiling point solvent in which the electron-donating dye precursor or the photolytic diazo compound dissolves well may be used simultaneously as an auxiliary solvent. Preferable examples of the low boiling point solvent include ethyl acetate, isopropyl acetate, butyl acetate and methylene chloride.

When the electron-donating dye precursor or the photolytic diazo compound is included in the heat-sensitive recording layer of the heat-sensitive recording material, the content of the precursor is preferably from 0.1 to 5.0 g/m$^2$, more preferably from 1.0 to 4.0 g/m$^2$. The content of the photolytic diazo compound is preferably from 0.02 to 5.0 g/m$^2$, more preferably from 0.10 to 4.0 g/m$^2$ from the viewpoint of the color density thereof.

When the content of the electron-donating dye precursor is within the above-mentioned range, a sufficient color density can be obtained. When the contents of the electron-donating dye precursor or the photolytic diazo compound is 5.0 g/m$^2$ or less, a sufficient color density can be obtained and the transparency of the heat-sensitive recording layer can be maintained.

The water phase may be an aqueous solution comprising a dissolved water-soluble polymer as a protective colloid. The above-mentioned oil phase is added to the water phase, and then the mixture is emulsified with a homogenizer or the like. The water-soluble polymer acts as a dispersing medium for achieving homogeneous dispersion easily and stabilizing the emulsified solution. A surfactant may be added to at least one of the oil phase and the water phase in order to achieve more homogenous and stable dispersion. As the surfactant, a well-known surfactant for emulsification can be used. The amount of the surfactant to be added is preferably from 0.1 to 5%, more preferably from 0.5 to 2% by weight of the amount of the oil phase.

As the surfactant added to the water phase, a surfactant which does not cause precipitation or aggregation caused by a reaction with the protective colloid is appropriately selected from anionic and nonionic surfactants.

Preferable examples of the surfactant include sodium alkylbenzenesulfonate, sodium alkylsulfate, sodium dioctyl sulfosuccinate, and polyalkylene glycol (such as polyoxyethylene nonyl phenyl ether).

The oil phase containing the above-mentioned components and the water phase containing the protective colloid and the surfactant can be emulsified in a known ordinary means for emulsifying fine particles, such as high-speed stirring means or ultrasonic wave dispersing means. Specific examples of the means include a homogenizer, a Manton-Gaulin, an ultrasonic wave disperser, a dissolver, or a Kdmill. In order to promote the reaction for forming capsule walls after the emulsification, it is preferable to heat the emulsion to a temperature of 30 to 70° C. In order to prevent the aggregation between the capsules during the reaction, it is preferable to add water to the reaction system so as to lower the probability of collision between the capsules, or perform stirring sufficiently.

During the reaction, a dispersion for preventing the aggregation may be newly added. With the advance of the polymerization reaction, the generation of carbon dioxide is observed. The termination of the generation can be regarded as the end point of the capsule wall forming reaction. Usually, target microcapsules can be obtained by several hours reaction.

Emulsion

If the electron-donating dye precursor or the photolytic diazo compound is capsulated as a core materiaf, the electron-donating compound or the coupler can be solid-dispersed together with, for example, a water-soluble polymer, an organic base, and other coloring auxiliary/auxiliaries, by means of a sand mill or the like before use. However, it is preferable to dissolve the electron-donating compound or the coupler in a high boiling point organic solvent which is scarcely soluble or insoluble in water, then mix this solution with an aqueous polymer solution (water phase) containing, as a protective colloid, a surfactant and/or a water-soluble polymer, then emulsify the resultant mixture by means of a homogenizer or the like, then use the emulsion. In this case, a low boiling point solvent may be used as a dissolving auxiliary if necessary.

The coupler and the organic base may be separately emulsified or may be mixed with each other, dissolved into a high boiling point organic solvent and emulsified. The size of the emulsified particle is preferably 1 μm or less.

The high boiling point organic solvent used in this case can be appropriately selected from the high boiling point oils described in JP-A No. 2-141279.

Among the oils, it is preferable to use esters from the viewpoint of the emulsification stability of the resultant emulsion. Among the esters, tricresyl phosphate is particularly preferable. The above oils may be used in any combination thereof, or the oil(s) may be used simultaneously with an oil other than the above oils.

The water-soluble polymer contained as the protective colloid can be appropriately selected from known anionic polymers, nonionic polymers and amphoteric polymers. The water-soluble polymer has a solubility in water of preferably 5% or more at a temperature at which the emulsification is conducted. Specific examples of the water-soluble polymer include: polyvinyl alcohol and modified products thereof; polyacrylic amide and derivatives thereof; ethylene-vinyl acetate copolymer; styrene-maleic anhydride copolymer; ethylene-maleic anhydride copolymer; isobutylene-maleic anhydride copolymer; polyvinyl pyrrolidone; ethylene-acrylic acid copolymer; vinyl acetate-acrylic acid copolymer; cellulose derivatives such as carboxymethylcellulose and methylcellulose; casein; gelatin; starch derivatives; gum arabic; and sodium alginate.

Among these polymers, polyvinyl alcohol, gelatin and cellulose derivatives are particularly preferable.

The mixing ratio of the oil phase to the water phase (the weight of the oil phase/the weight of the water phase) is preferably from 0.02 to 0.6, more preferably from 0. 1 to 0.4. When the mixing ratio is within the range of 0.02 to 0.6, the coating solution has an appropriate viscosity and stability, thus the production of the heat-sensitive recording material is easier.

When the electron-accepting compound is included in the heat-sensitive recording material of the invention, the amount of the electron-accepting compound is preferably from 0.5 to 30 parts, more preferably from 1.0 to 10 parts by mass per part by mass of the electron-donating dye precursor.

When the coupler is included in the heat-sensitive recording material of the invention, the amount of the coupler is preferably from 0.1 to 30 parts by mass per part by mass of the diazo compound.

Coating Solution for Forming Heat-Sensitive Recording Layer

The coating solution for forming the heat-sensitive recording layer can be prepared, for example, by mixing the microcapsule solution and the emulsion prepared as described above. The water-soluble polymer used as a protective colloid during the preparation of the microcapsule solution and the water-soluble polymer used as a protective colloid during the preparation of the emulsion function as binders in the heat-sensitive recording layer. A binder different from the protective colloids may be further added during the preparation of the coating solution for forming the heat-sensitive recording layer.

The binder to be further added is generally a water-soluble binder. Examples thereof include polyvinyl alcohol, hydroxyethylcellulose, hydroxypropylcellulose, epichlorohydrin-modified polyamide, ethylene-maleic anhydride copolymer, styrene-maleic anhydride copolymer, isobutylene-maleic anhydride-salicylic acid copolymer, polyacrylic acid, polyacrylic amide, methylol-modified polyacrylamide, starch derivatives, casein, and gelatin.

To the binders, an water-resistance imparting agent may be added in order to provide water resistance, and/or an emulsion made of a hydrophobic polymer, specific examples of which include styrene-butadiene rubber latex and acrylic resin emulsion, may be added.

When the coating solution for forming the heat-sensitive recording layer is applied to a support, a known applying means used for water-based or organic solvent-based coating solution is used. In this case, in order to apply the coating solution for forming the heat-sensitive recording layer nicely and uniformly and maintain the strength of the coating, at least one selected form the following can be included in the coating solution in the case of the heat-sensitive recording material of the invention: methylcellulose, carboxymethylcellulose, hydroxyethylcellulose, starch, gelatin, polyvinyl alcohol, carboxy-modified polyvinyl alcohol, polyacrylamide, polystyrene or copolymers thereof, polyester or copolymers thereof, polyethylene or copolymers thereof, epoxy resin, acrylate type resin or copolymers thereof, methacrylate type resin or copolymers thereof, polyurethane resin, polyamide resin, and polyvinyl butyral resin.

Other Components

Other components that can be used in the heat-sensitive recording layer will be described hereinafter.

Such other components can be appropriately selected, without particular limitation, in accordance with a purpose. Examples thereof include known additives such as a thermally-meltable material, an ultraviolet absorber, and an antioxidant.

The amount of each of such other components to be applied is preferably from about 0.05 to 1.0 g/m$^2$, more preferably from about 0.1 to 0.4 g/m$^2$. Such components may be included in the inside and/or the outside of the microcapsules.

The thermally-meltable material can be included in the heat-sensitive recording layer in order to improve the thermal responsiveness thereof.

Examples of the thermally-meltable material include am aromatic ether, a thioether, an ester, an aliphatic amide and an ureido. Examples of these compounds are described in JP-A Nos. 58-57989, 58-87094, 61-58789, 62-109681, 62-132674, 63-151478, 63-235961, 2-184489, 2-215585 etc.

Preferable examples of the ultraviolet ray absorber include benzophenone type ultraviolet ray absorbers, benzotriazole type ultraviolet ray absorbers, salicylic acid type ultraviolet ray absorbers, cyanoacrylate type ultraviolet ray absorbers, and oxalic acid anilide type ultraviolet ray absorbers. Examples thereof are described in JP-A Nos. 47-10537, 58-111942, 58-212844, 59-19945, 59-46646, 59-109055 and 63-53544, Japanese Patent Application Publication (JP-B) Nos. 36-10466, 42-26187, 48-30492, 48-31255, 48-41572, 48-54965 and 50-10726, and U.S. Pat. Nos. 2,719,086, 3,707,375, 3,754,919 and 4,220,711.

Examples of the antioxidant include hindered amine type antioxidants, hindered phenol type antioxidants, aniline type antioxidants, and quinoline type antioxidants. Examples thereof are described in JP-A Nos. 59-155090, 60-107383, 60-107384, 61-137770, 61-139481, 61-160287 etc.

The heat-sensitive recording layer is preferably such a heat-sensitive recording layer that the energy required for obtaining a saturated transmission density ($D_{T\text{-}max}$) is high, that is, the dynamic range is wide, for the purpose of suppressing defects resulting from a slight variance in the thermal conductivity of the thermal head and giving a high-quality image. It is preferable that the heat-sensitive recording material of the invention should comprises such a heat-sensitive recording layer and the heat-sensitive recording layer should have such a characteristic that a saturated transmission density ($D_{T\text{-}max}$) of 3.0 can be obtained at a thermal energy of 90 to 150 mJ/mm$^2$.

It is preferable that the heat-sensitive recording layer should be applied such that a dry application amount thereof, which is the amount of the layer after drying, will be from 1 to 25 g/m$^2$ and the thickness of the layer will be set to a thickness of 1 to 25 μm. A plurality of such heat-sensitive recording layers may be provided. In this case, the dry application amount of all the heat-sensitive recording layers is preferably from 1 to 25 g/m$^2$.

Other Layers

In the heat-sensitive recording material of the invention, an intermediate layer, an undercoat layer and the like can be further provided on the side of the support having the heat-sensitive recording layer and the protective layer.

Intermediate Layer

An intermediate layer is preferably provided on the heat-sensitive recording layer.

The intermediate layer is provided to prevent the intermixing of the layers and block a gas (such as oxygen) harmful to image storability. The kind of the binder included therein is not particularly limited. In accordance with the system, at least one of polyvinyl alcohol, gelatin, polyvinyl pyrrolidone, cellulose derivatives and the like can be used. Various surfactants may be added to the intermediate layer in order to make the application thereof easy. In order to improve the gas barrier ability thereof, inorganic fine particles made of mica or the like may be added to the binder in an amount of 2 to 20%, preferably 5 to 10% by mass of the amount of the binder.

Undercoat Layer

In order to prevent the peeling of the heat-sensitive recording layer from the support, an undercoat layer may be provided on the support before the heat-sensitive recording layer, the protective layer and the like are provided on the support.

The undercoat layer may comprise at least one selected from acrylic ester copolymers, polyvinylidene chloride, SBR, aqueous polyesters and the like. The thickness thereof is preferably from 0.05 to 0.5 μm.

When the heat-sensitive recording layer is provided on the undercoat layer, the undercoat layer may swell by water contained in the coating solution for forming the heat-sensitive recording layer so that the image recorded in the heat-sensitive recording layer may deteriorate. It is therefore preferable to use a hardening agent such as a dialdehyde (such as glutaraldehyde or 2,3-dihydroxy-1,4-dioxane) or boric acid to harden the layer. The amount of the hardening agent to be added may be appropriately determined within the range of 0.2 to 3.0% by mass of the dry amount of the undercoat layer in accordance with a desired hardness.

Support

The support in the heat-sensitive recording material of the invention is preferably transparent in order to ensure transparency of the heat-sensitive recording material. The transparent support is preferably a polymer film. Examples of the polymer film include polyester films such as polyethylene terephthalate films or polybutylene terephthalate films, triacetate cellulose films, and polyolefin films such as polypropylene films and polyethylene films. A single film may be used to form the support or a lamination of films may be used to form the support.

The thickness of the polymer film is preferably from 25 to 250 μm, more preferably from 50 to 200 μm.

The polymer film may be colored in any color hue. Examples of the method for coloring the polymer film include: a method of mixing a dye with a resin, kneading the mixture, then molding the kneaded mixture into a film; and a method of preparing a coating solution in which a dye is dissolved in a suitable solvent, and applying this solution to a colorless and transparent resin film by a known coating method such as a gravure coating, roller coating or wire coating method. Among them, preferable is a method of molding a polyester resin, such as polyethylene terephthalate or polyethylene naphthalate, including a blue dye uniformly, into a film, and then subjecting this film to heat-resistance providing treatment, drawing treatment and antistatic treatment.

In particular, when the transparent heat-sensitive recording material of the invention on a schaukasten is observed from the side of the support, schaukasten light transmitting transparent non-image portions of the recording material may dazzle the observer to inhibit recognition of the image.

In order to avoid this situation, it is particularly preferable to use, as the transparent support, a synthetic polymer film colored in blue color which is in a square whose four vertexes are A (x=0.2805, y=0.3005), B (x=0.2820, y=0.2970), C (x=0.2885, y=0.3015), D (x=0.2870, y=0.3040) on chromaticity coordinates defined by the method described in JIS-Z8701.

It is preferable that the support should have, on the opposite to the side having the heat-sensitive recording layer and the protective layer, at least a back layer. If necessary, the support may have, on said opposite side, other layer(s) such as an ultraviolet ray filter layer and an antireflection layer.

Back Layer

The back layer comprises at least a water-soluble binder. Preferably, the back layer may be mainly composed of a water-soluble binder. A single back layer may be provided or a plurality of such back layers may be provided. If necessary, the back layer may contain other component(s) such as a hardening agent, a matting agent, an ultraviolet ray absorber, a dye, a pH adjusting agent, a preservative, and a surfactant.

The back layer(s) can be provided by applying a coating solution such that the total amount of the applied water-soluble binder becomes 1 to 10 g/m$^2$. In other words, the total amount of the water-soluble binder contained in the back layer(s) is can be 1 to 10 g/m$^2$.

Preferably, a plurality of such back layers should be provided since the layers can be applied without causing obstacles while the amount of the applied water-soluble binder can be increased.

If the total amount of the applied binder is not within the above-mentioned range, deformation, such as curl, after thermal printing cannot be sufficiently prevented. In particular, if the total amount is less than 1 g/m$^2$, the side having the back layer does not balance the side having the heat-sensitive recording layer and the protective layer. Consequently, deformation after recording cannot be avoided. If the total amount is more than 10 g/m$^2$, the side having the back layer does not balance the side having the heat-sensitive recording layer and the protective layer. As a result, for example, the heat-sensitive recording material curls toward the back layer side.

Examples of the water-soluble binder include: water-soluble polymers such as vinyl acetate-acrylamide copolymer, polyvinyl alcohols (silicon-modified polyvinyl alcohol, acetyl-modified polyvinyl alcohol, and fluorinated acetyl-modified polyvinyl alcohol), starch, modified starch, methylcellulose, carboxymethylcellulose, hydroxymethylcellulose, gelatins, gum arabic, casein, styrene-maleic acid copolymer hydrolyzates, styrene-maleic acid copolymer half-ester hydrolyzates, isobutyrene-maleic anhydride copolymer hydrolyzates, polyacrylamide derivatives, polyvinyl pyrrolidone, sodium polystyrenesulfonate, and sodium alginate; and water-insoluble polymers such as styrene-butadiene rubber latex, acrylonitrile-butadiene rubber latex, methyl acrylate-butadiene rubber latex, and vinyl acetate emulsion.

Among these water-soluble binders, gelatins are preferable. Among gelatins, an alkali-treated gelatin having a particularly low isoelectric point and a gelatin derivative whose amino groups have been subjected to reaction (for example, phthalated gelatin) are preferable.

A single kind of water-soluble binder may be used or a plurality kinds of water-soluble binders may be used simultaneously. If a plurality of such back layers are provided, it is preferable that at least two of the layers should include gelatin and the at least two of the layers may include other water-soluble binder(s).

The back layer may further contain a hardening agent for reacting with the water-soluble binder (in particular, gelatin) to harden the film and give water resistance to the film.

Examples of the hardening agent include the agents described in "*THE THEORY OF THE PHOTOGRAPHIC PROCESS FORTH EMOTION*" (written by T. H. James), pp.77–87. Among them, vinylsulfone type compounds are preferable.

The back layer may further contain a matting agent in order to improve the transporting property of the heat-sensitive recording material and provide the antireflection property to the heat-sensitive recording material. The matting agent may be any of the matting agents which are cited as examples in the explanation of the protective layer.

It is preferable that the back layer which is farthest from the support should include a fluorine-type surfactant as a coating auxiliary or an antistatic agent.

Examples of the fluorine-type surfactant include potassium perfluorooctanesulfonate, N-propyl-N-oxyethylene perfluorooctanesulfonamide, sodium butylsulfonate, trimethyl(propyleneaminosulfonylperfluorooctane)ammonium chloride, and sodium N-propyl-N-oxyethyleneperfluorooctanesulfonate.

A coating solution for forming a back layer may include a thickener for adjusting the viscosity thereof so as to make the application of the coating solution easier. An ultraviolet ray absorber may be added to the coating solution in order to heighten the light fastness of recorded images. The thickener or the ultraviolet ray absorber can be appropriately selected from known thickeners or ultraviolet absorbers.

In order to improve the color hue of the heat-sensitive recording material, a dye such as C. I. Pigment Blue 60, C. I. Pigment Blue 64, or C. I. Pigment Blue 15:6 may be added to the back layer.

In order to maintain the stability of a coating solution for forming the back layer, a pH adjusting agent capable of adjusting pH, such as sodium hydroxide, may be added thereto.

A preservative may be added to the back layer in order to prevent deterioration of a coating solution for forming the back layer and deterioration of the heat-sensitive recording material. The preservative can be appropriately selected from known preservatives.

When a plurality of such back layers are provided, each of the above optional components may be included in any layer(s). The optional components may be appropriately contained as far as the advantageous effects of the invention are retained.

The coating method for providing the back layer may be a known coating method, such as blade coating, air-knife coating, gravure coating, roll coating, spray coating, dip coating, or bar coating. When a plurality of such back layers are provided, the layers may be provided by simultaneous multilayer coating.

The side of the support opposite to the heat-sensitive recording layer and the protective layer may have not only the back layer but also a "layer which contains polyvinyl alcohol" (hereinafter referred to as a "PVA layer" on occasion) adjacent to the back layer since the behavior of the heat-sensitive recording material before the extent of curl reaches an equilibrium immediately after an image is printed can be controlled. The PVA layer is provided on the side of the support having the back layer, and may be provided on the surface of the back layer which is farthest from the support or may be provided between the support and the back layer. If a plurality of such back layers are provided, the PVA layer may be provided between the back layers. A plurality of such PVA layers may be provided.

Preferable examples of the polyvinyl alcohol include completely-saponificated polyvinyl alcohol, carboxy-modified polyvinyl alcohol, and silica-modified polyvinyl alcohol.

The content of the polyvinyl alcohol in the PVA layer is preferably from 50 to 100% by mass of the solids content in the layer.

The PVA layer may further contain a surfactant. Examples of the surfactant include sodium alkylbenzenesulfonate, sodium alkylsulfate, sodium dioctylsulfosuccinate, and polyalkylene glycol.

In the same manner as in the case of the back layer, the PVA layer can be provided by applying a coating solution including polyvinyl alcohol. The thickness of this layer is preferably from 0.5 to 10 μm.

The heat-sensitive recording material of the invention is prepared by applying a coating solution for forming the heat-sensitive recording layer to a support to form the heat-sensitive recording layer, applying a coating solution for forming the protective layer to form the protective layer, and optionally providing other layer(s).

The support used herein may be the support described in the foregoing. The coating solution for forming the heat-sensitive recording layer used herein may be the above-mentioned coating solution for forming the heat-sensitive recording layer, and the coating solution for forming the protective layer used herein may be the above-mentioned coating solution for forming the protective layer comprising the acetylene glycol derivative represented by the formula (1), the water-insoluble dispersion, and the water-insoluble organic material in a form of an emulsion. Examples of said other layers include the above-mentioned undercoat layer and the above-mentioned intermediate layer. The heat-sensitive recording material of the invention may be prepared by applying these coating solutions by any method. Specifically, the following may be used: extrusion coating, slide coating, curtain coating, knife coating, dip coating, flow coating, or various excursion die coating manners (such as extrusion coating using a hopper of the kind described in U.S. Pat. No. 2,681,294). The extrusion coating described in Stephen F. Kistler and Petert M. Schwaizer *LIQUID FILM COATING* (CHAPMAN & HALL Co., 1997): pp. 399–536 or the slide coating is preferably used. It is particularly preferable to use the slide coating. Examples of the shape of a slide coater used in the slide coating are described in FIG. 11b.1 on page 427 of the above document. If desired, two or more layers can be simultaneously applied by the method described on pages 399–536 of the above document or in U.S. Pat. No. 2,761,791 or GB Patent No. 837,095. The heat-sensitive recording material is dried with drying air having a dry-bulb temperature of 20 to 65° C., preferably 25 to 55° C., and a wet-bulb temperature of 10 to 30° C., preferably 15 to 25° C.

In the preparation of the heat-sensitive recording material of the invention, the heat-sensitive recording layer and the protective layer may be simultaneously provided. In this case, all the layers including the heat-sensitive recording layer and the protective layer are preferably provided at the same time by multilayer coating in the above-mentioned extrusion die manner. By such a simultaneous multilayer coating of the all layers, a heat-sensitive recording layer having better surface condition can be obtained.

The coating speed in the multilayer coating is preferably 100 m/min or more, more preferably 140 m/min or more from the viewpoint of the productivity of the heat-sensitive recording material. In general, the frequency of the occurrence of surface deficiencies becomes higher as the coating speed becomes higher. In the invention, however, the frequency of the occurrence of surface deficiencies is small even when the coating speed is high. Therefore, the effect of the surface state improvement is more remarkable as the coating speed in the multilayer coating becomes higher.

Images can be recorded well on the heat-sensitive recording material of the invention by a heat-generating element such as a thermal head. The thermal head to be used is preferably a thermal head produced by providing a protective layer on a heating element that has a heating resistor and electrodes on a glaze layer, by means of a known film-forming device such that the proportion of the carbon in the uppermost layer, which will contact with the heat-sensitive recording material, is 90% or higher. A plurality of such head protective layers may be provided. In such a case, it is necessary that the proportion of carbon in the uppermost layer should be at least 90% or higher.

EXAMPLES

The present invention will be further explained by the following examples hereinafter. However, the invention is by no means limited to these examples. In the examples, the symbol "%" refers to "% by mass".

Example 1

Preparation of Coating Solution for Forming First Back Layer

Water was added to the composition described below so as to adjust the total volume to 28.54 L. In this way, a coating solution for forming a first back layer (hereinafter referred to as a "BC layer coating solution") was obtained. The amount of water-soluble binders in the present layer was the total amount of the following lime-treated gelatin and gelation in the following gelatin dispersion including 12% of a spherical PMMA matting agent.

| Composition of the BC layer coating solution | |
|---|---|
| Lime-treated gelatin (water-soluble binder): | 1000 g |
| Gelatin dispersion including 12% of a spherical PMMA matting agent (average particle size: 5.7 μm): | 334 g |
| Emulsion of ultraviolet ray absorbers represented by the following structural formulae [1] to [5], the amounts of respective ultraviolet ray absorbers being described in the following: | 1,517 g |
| [The amounts of the ultraviolet absorbents per kg of the emulsion were as follows: | |
| Compound represented by the structural formula [1]: | 14.9 g |
| Compound represented by the structural formula [2]: | 12.7 g |
| Compound represented by the structural formula [3]: | 14.9 g |
| Compound represented by the structural formula [4]: | 21.1 g |
| Compound represented by the structural formula [5]: | 44.5 g] |
| 1,2-benzisothiazoline-3-one: | 1.72 g |
| Sodium poly-p-vinylbenzenesulfonate (molecular weight: about 400,000): | 22.5 g |
| Compound represented by the following Structural formula [6]: | 8.45 g |
| 20% latex solution of polyethyl acrylate: | 3,219 ml |
| N,N-ethylene-bis(vinylsulfonylacetoamide): | 75.0 g |
| 1,3-bis(vinylsulfonylacetoamide)propane: | 25.0 g |

[1]

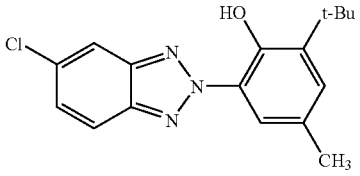

[2]

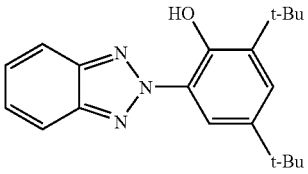

-continued

[3]

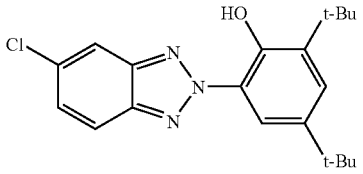

[4]

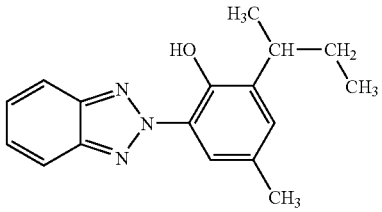

[5]

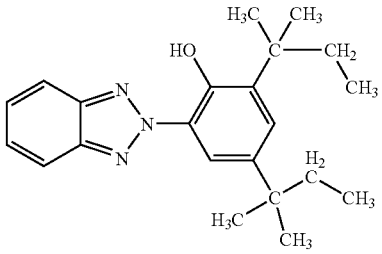

[6]

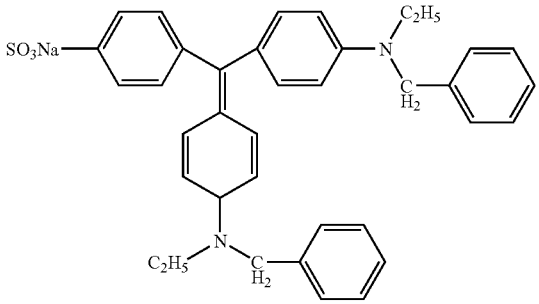

Preparation of Coating Solution for Forming Second Back Layer

Water was added to the composition described below so as to adjust the total volume to 25.00 1. In this way, a coating solution for forming a second back layer (hereinafter referred to as a "BPC layer coating solution") was obtained. The amount of water-soluble binders in this layer was the total amount of the following lime-treated gelatin and gelation in the following gelatin dispersion including 15% of a spherical PMMA matting agent.

| Composition of the BPC layer coating solution | |
|---|---|
| Lime-treated gelatin (water-soluble binder): | 1,000 g |
| Gelatin dispersion including 15% of a spherical PMMA matting agent (average particle size: 0.70 μm): | 1,038 g |
| 1,2-benzisothiazoline-3-one: | 2.09 g |
| Sodium p-t-octylphenoxypolyoxyethylene ethylsulfonate: | 9.53 g |
| Sodium polyacrylate (molecular weight: about 100,000): | 57.9 g |
| Sodium poly-p-vinylbenzenesulfonate (molecular weight: about 400,000): | 22.5 g |
| Sodium N-propyl-N-polyoxyethylene-perfluorooctanesulfonamide butylsulfonate: | 0.37 g |
| Hexadecyloxy-nonyl(ethyleneoxy)-ethanol: | 8.97 g |

-continued

| Composition of the BPC layer coating solution | |
|---|---|
| 1 N sodium hydroxide aqueous solution: | 28.1 g |
| N,N-ethylene-bis(vinylsulfonylacetoamide): | 18.0 g |
| 1,3-(vinylsulfonylacetoamide)propane: | 6.0 g |

Formation of the BC Layer and the BPC Layer

A transparent PET support (thickness: 180 μm) dyed in a blue color whose chromaticity coordinates defined by the method described in JIS-Z8701 are (x=0.2850, y=0.2995), was prepared. The BC layer coating solution and the BPC layer coating solution obtained as described above were applied on the transparent PET support in a simultaneous multilayer coating manner by a slide bead method so that the amount of the applied BC layer coating solution was 47.4 $ml/m^2$ and the amount of the applied BPC layer coating solution was 13.4 $ml/m^2$, wherein the BC layer coating solution was nearer to the support than the BPC layer coating solution. Then, the coated PET support was dried. Conditions of the application and the drying were as follows.

The application speed was set to 160 m/min. The gap between the tip of the coating die and the support was 0.10 to 0.30 mm. The pressure in the pressure-reducing room was 196 to 882 Pa lower than the atmospheric pressure. The electricity of the support was removed by ionized wind before the application.

Subsequently, in a chilling zone, the coating solutions were cooled with wind having a dry-bulb temperature of 10 to 20° C., and then the coating solutions were transported to a helical type non-contact type drying machine in a non-contact manner, and dried with dry wind having a dry-bulb temperature of 23 to 45° C. and a wet-bulb temperature of 15 to 21° C. by the drying machine.

In this way, two back layers were provided on one side of the transparent PET support. The total application amount of the water-soluble binders contained in the two back layers was 2.20 $g/m^2$.

Preparation of Coating Solution for Forming a Protective Layer

Preparation of a Pigment Dispersion for a Protective Layer

To 110 g of water, 30 g of stearic-acid-treated aluminum hydroxide (trade name: HIGILITE H42S, manufactured by Showa Denko K. K.) was added as a pigment. The mixture was stirred for 3 hours, and then thereto were added 0.8 g of a dispersing auxiliary (trade name: POIZ 532A, manufactured by Kao Corp.), 30 g of a 10% polyvinyl alcohol aqueous solution (trade name: PVA 105, manufactured by Kuraray Co., Ltd.) and 10 g of a 2% aqueous solution of a compound represented by the following structural formula [100].

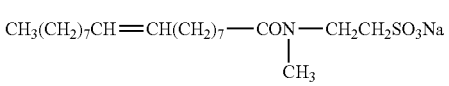

[100]

These components in the resultant mixture were dispersed by a sand mill to form a pigment dispersion for a protective layer including particles having an average particle size of 0.30 μm.

The "average particle size" of the pigment particles refers to the 50%-volume average particle diameter of the pigment particles measured by a laser diffraction particle size distribution meter (trade name: LA 700, manufactured by Horiba Ltd.), wherein after the pigment was dispersed in the presence of the dispersing auxiliary, water was added to the pigment dispersion immediately after the dispersing so as to dilute the solution to 0.5%, the resultant test solution was poured into 40° C. hot water so as to adjust the light transmission factor thereof to 75±1.0%, and the solution was treated with ultrasonic waves for 30 seconds, the size was measured. All of "average particle sizes" described hereinafter were measured in the same way.

Preparation of Coating Solution for Forming Protective Layer

The following materials were mixed with 65 g of water, to form a coating solution for forming a protective layer.

| | |
|---|---|
| 8% polyvinyl aqueous solution (trade name: PVA124C, manufactured by Kuraray Co., Ltd.): | 90 g |
| 20.5% zinc stearate emulsion (trade name: F-115, manufactured by Chukyo Oil & Fat Co., Ltd.): | 5.5 g |
| 21.5% stearic amide emulsion (trade name: G-270, manufactured by Chukyo Oil & Fat Co., Ltd.): | 3.8 g |
| 18.0% stearic acid emulsion (trade name: SELOZOL 920), manufactured by Chukyo Oil & Fat Co., Ltd.: | 2.8 g |
| 4% boric acid aqueous solution: | 10 g |
| The above-described pigment dispersion for a protective layer (18%): | 70 g |
| 35% emulsion of silicone oil in water (trade name: BY22-840, manufactured by Toray Dow Corning): | 4.7 g |
| 10% sodium dodecylbenzenesulfonate aqueous solution: | 6.5 g |
| 6% aqueous solution of ammonium salt of styrene-maleic acid copolymer (trade name: POLYMALON 385, manufactured by Arakawa Chemical Industries. Ltd.): | 17.5 g |
| 20% colloidal silica (SNOWTEX ®, manufactured by Nissan Chemical Industries. Ltd.): | 14 g |
| 10% Fluorinated surfactant (trade name: SURFLON S131S, manufactured by Asahi Glass Co., Ltd.): | 16 g |
| Polyoxyethylene alkyl ether phosphate ester (trade name: PLYSURF A217, manufactured by Dai-ichi Kogyo Seiyaku Co., Ltd.): | 1.1 g |
| 2% acetic acid: | 8 g |
| 5% solution of nonionic surfactant (trade name: SURFYNOL 104E, manufactured by Nissin Chemical Industry Co., Ltd.) in methanol: | 15.58 g |

Preparation of Coating Solution for Forming Heat-sensitive Recording Layer

Each of a microcapsule solution and a coloring agent emulsion were prepared as follows.

Preparation of a Microcapsule Solution A

The following compounds were added as coloring agents to 24.3 g of ethyl acetate:

Compound represented by the following structural formula [201]: 11.7 g,

Compound represented by the following structural formula [202]: 1.5 g,

Compound represented by the following structural formula [203]:2.2 g,

Compound represented by the following structural formula [204]: 5.65 g,

Compound represented by the following structural formula [205]: 1.2 g,

Compound represented by the following structural formula [206]: 1.1 g, and

Compound represented by the following structural formula [207]: 0.57 g.

[201]

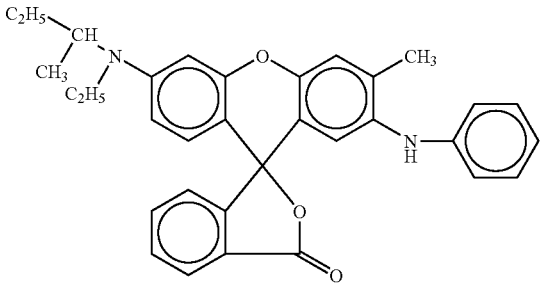

[202]

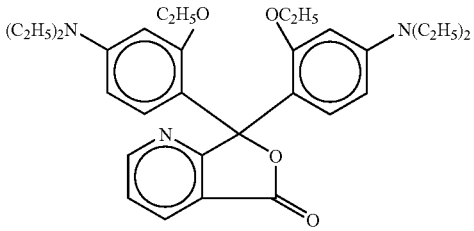

[203]

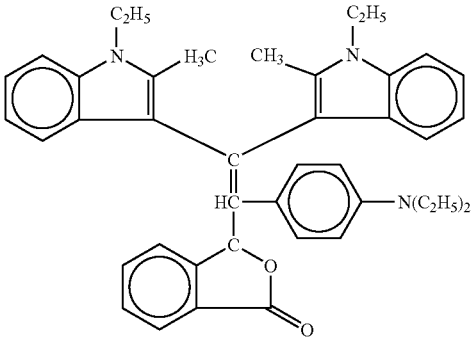

[204]

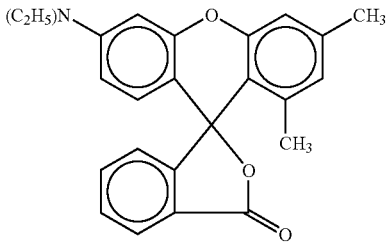

[205]

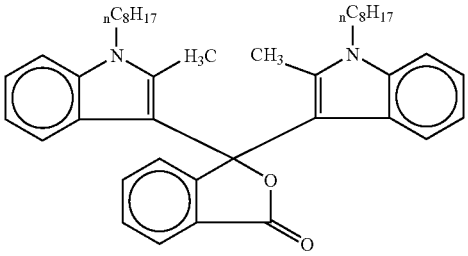

-continued

[206]

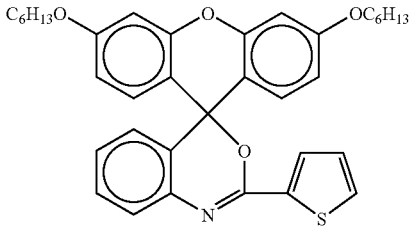

[207]

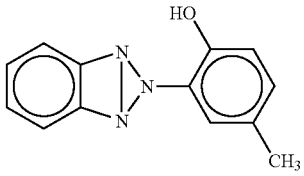

The resultant mixture was heated to 70° C. to dissolve the compounds, and then cooled to 45° C. 13.1 g of a capsule wall material (trade name: TAKENATE D140N, manufactured byTakeda Chemical Industries, Ltd.) and 2.3 g of a polyisocyanate crosslinker (BURNOCK® D750, manufactured by Dainippon Ink & Chemicals, Inc.) were mixed with the mixture.

The resultant solution was added to a water phase obtained by adding 48 g of a 8% polyvinyl alcohol aqueous solution (trade name: PVA 217C, manufactured by Kuraray Co., Ltd.) to 16 g of water. Thereafter, an ACE homogenizer (trade name, manufactured by Nippon Seiki Co., Ltd.) was used to emulsify the mixture at a rotation number of 15,000 rpm for 5 minutes. 110 g of water and 1.0 g of tetraethylenepentamine were further added to the resultant emulsion, and then encapsulating reaction was continued at 60° C. for 4 hours so as to form a microcapsule solution A (solids content: 23%) having an average particle size of 0.35 μm.

Preparation of a Microcapsule Solution B

The following compounds were added to 21 g of ethyl acetate:

Compound represented by the following structural formula [201]: 12.2 g,

Compound represented by the following structural formula [202]: 1.6 g,

Compound represented by the following structural formula [203]: 2.4 g,

Compound represented by the following structural formula [204]: 3.3 g,

Compound represented by the following structural formula [205]: 1.5 g,

Compound represented by the following structural formula [206]: 0.2 g, and

Compound represented by the following structural formula [207]: 0.5 g.

The resultant was heated to 70° C. so that the compounds were dissolved, and then cooled to 35° C. 0.5 g of n-butanol, 14.1 g of isocyanate prepolymer (trade name: TAKENATE D127N, manufactured by Takeda Chemical Industries, Ltd.), and 2.5 g of isocyanate prepolymer (trade name: TAKENATE D110N, manufactured by Takeda Chemical Industries, Ltd.) were added thereto. The temperature of the resultant mixture was maintained at 35° C. for 40 minutes.

The resultant solution was added to a water phase obtained by adding 48.1 g of a 8% polyvinyl alcohol aqueous solution (trade name: PVA 217C, manufactured by Kuraray Co., Ltd.) to 16.6 g of water. Thereafter, an ACE homogenizer (trade name: manufactured by Nippon Seiki Co., Ltd.) was used to emulsify the mixture at a rotation number of 15,000 rpm for 5 minutes. To the resultant emulsion, 112 g of water and 0.9 g of tetraethylenepentamine were further added, and then encapsulating reaction was continued at 60° C. for 4 hours so as to form a microcapsule solution B (solids content: 24%) having an average particle size of 0.35 μm.

Preparation of a Coloring Agent Emulsion

To 16.5 g of ethyl acetate, the following compounds were added together with 1.0 g of tricresyl phosphate and 0.5 g of diethyl maleate:

Compound represented by the following structural formula [301]: 6.7 g,

Compound represented by the following structural formula [302]: 8.0 g,

Compound represented by the following structural formula [303]: 5.8 g,

Compound represented by the following structural formula [304]: 1.5 g,

Compound represented by the following structural formula [305]: 2.2 g,

Compound represented by the following structural formula [306]: 0.8 g, and

Compound represented by the following structural formula [307]: 4.3 g.

[301]

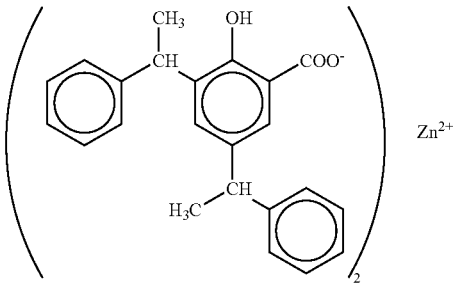

[302]

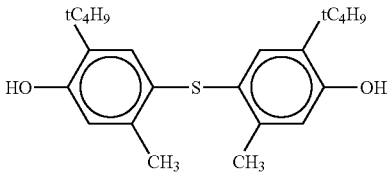

[303]

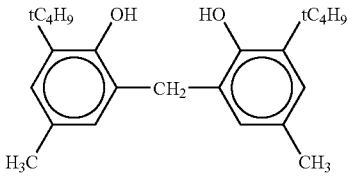

[304]

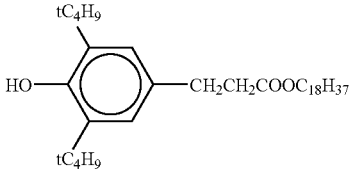

-continued

[305]

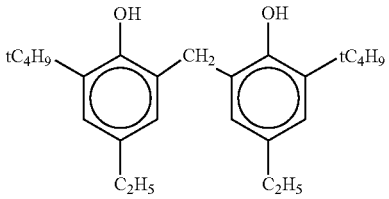

[306]

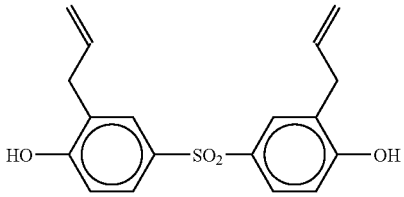

[307]

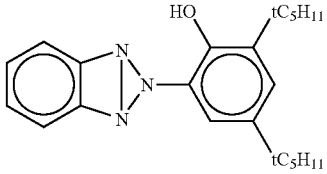

The mixture was heated to 70° C. so that the coloring agents were dissolved. This solution was added to a water phase obtained by mixing 70 g of water, 57 g of a 8% polyvinyl alcohol aqueous solution (trade name: PVA 217C, manufactured by Kuraray Co., Ltd.), 20 g of a 15% polyvinyl alcohol aqueous solution (trade name: PVA 205C, manufactured by Kuraray Co., Ltd.), and 11.5 g of an aqueous solution including 2% of a compound represented by the following structural formula [401] and 2% of a compound represented by the following structural formula [402].

[401]

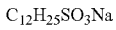

[402]

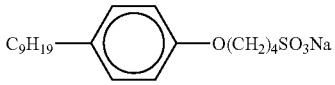

Thereafter, an ACE homogenizer (trade name, manufactured by Nippon Seiki Co., Ltd.) was used to emulsify the mixture at a rotation number of 10,000 rpm so as to obtain an average particle size of 0.7 μm. In this way, a coloring agent emulsion (concentration of solid content: 22%) was obtained.

Preparation of Coating Solution A for Forming Heat-sensitive Recording Layer

The following were mixed to prepare a coating solution A for forming a heat-sensitive recording layer: 12 g of the microcapsule solution A, 2.5 g of the microcapsule solution B, 50 g of the coloring agent emulsion, 0.7 g of a 50% solution of a compound represented by the following structural formula [403] in water, and 1.8 g of colloidal silica (SNOWTEX®, manufactured by Nissan Chemical Industries, Ltd.).

[403]

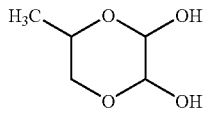

Preparation of Coating Solution B for Forming Heat-sensitive Recording Layer

The following materials were mixed to prepare a coating solution B for forming a heat-sensitive recording layer.

| | |
|---|---|
| The microcapsule solution A: | 2.3 g |
| The microcapsule solution B: | 6.6 g |
| The coloring agent emulsion: | 33 g |
| Colloidal silica (SNOWTEX ®, manufactured by Nissan Chemical Industries, Ltd.): | 1.5 g |
| 50% aqueous solution of the compound represented by the structural formula [403]: | 0.4 g |

Preparation of Coating Solution C for Forming Heat-sensitive Recording Layer

In 5 g of water, 35 g of a 6% PVA aqueous solution (trade name: PVA 124C, manufactured by Kuraray Co., Ltd.), 2 g of a 2% aqueous solution of a compound represented by the following structural formula [404], and 0.5 g of the microcapsule solution A were dissolved to prepare a coating solution C for forming a heat-sensitive recording layer.

[404]

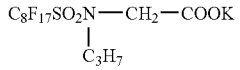

Preparation of Coating Solution for Forming Intermediate Layer 1000 g of lime-treated gelatin was added to 7848 g of water and dissolved, and then 137 g of a 5% solution of a sodium salt of di-2-ethylhexylsulfosuccinate (trade name: NISSAN RAPISOL B90, manufactured by Nippon Oil & Fats Co., Ltd.) in a mixed solvent of water and methanol (water/methanol=1/1 (v/v)) was added to the gelatin solution, so as to prepare a coating solution for forming an intermediate layer.

Production of a Heat-sensitive Recording Material

The coating solution A for forming a heat-sensitive recording layer, the coating solution B for forming a heat-sensitive recording layer, the coating solution for forming an intermediate layer, the coating solution C for forming a heat-sensitive recording layer, and the coating solution for forming a protective layer were simultaneously applied to the surface of the transparent PET support (thickness: 175 μm), the surface being opposite to the side having the BC layer and the BPC layer were applied, in simultaneous multilayer coating manner by a slide bead method, and then dried. These coating solutions were disposed in that order from the side nearer to the support, that is, the coating solution A for forming a heat-sensitive recording layer was nearest to the support. The application amount of the coating solution A for forming a heat-sensitive recording layer was 50 ml/m$^2$, the application amount of the coating solution B for forming a heat-sensitive recording layer was 20 ml/m$^2$, the application amount of the coating solution for forming an intermediate layer was 18.2 ml/m$^2$, the application amount of the coating solution C for forming a heat-sensitive recording layer was 25 ml/m$^2$, and the application amount of the coating solution for forming a protective layer was 25 ml/m$^2$. In this way, a heat-sensitive recording material (1) of the present invention having, from the side nearer to the support, a heat-sensitive recording layer A, a heat-sensitive recording layer B, an intermediate layer A, a heat-sensitive recording layer C, and a protective layer was prepared.

Conditions of the Application and the Drying were as Follows.

The application speed was 160 m/min. The gap between the tip of the coating die and the support was from 0.10 to 0.30 mm. The pressure in the pressure-reducing room was 196 to 882 Pa lower than the atmospheric pressure. The electricity of the PET support was removed by ionized wind before the application.

Subsequently, in a first drying zone, the applied coating solutions were initially dried by wind having a dry-bulb temperature of 40 to 60° C., a dew point of 0° C. and a film surface wind speed of 5 m/sec or less, and then transported in a non-contact manner to a helical type non-contact type drying machine. Thereafter, the applied coating solutions were dried by dry wind having a dry-bulb temperature of 23 to 45° C., a relative humidity of 20 to 70% RH, and a film surface wind speed of 15 to 25 m/sec by means of the drying machine while the film surface temperature thereof was kept in a range of 18 to 23° C.

The proportion of the acetylene glycol derivative represented by the formula (1) in solids content in the protective layer was 2.4%.

Example 2

A heat-sensitive recording material (2) of the invention was produced in the same way as in Example 1 except that the 5% solution of SURFYNOL 104E in methanol (described above) was changed to a 5% solution of ethyleneoxide-added acethylene diol (trade name: Olfin E1004, manufactured by Nissin Chemical Industry Co., Ltd.) in methanol in the preparation of the coating solution for forming a protective layer.

Example 3

A heat-sensitive recording material (3) of the invention was produced in the same way as in Example 1 except that the 5% solution of SURFYNOL 104E (described above) in methanol was changed to a 5% solution of ethyleneoxide-added acethylene diol (trade name: Olfin E1010, manufactured by Nissin Chemical Industry Co., Ltd.) in methanol in the preparation of the coating solution for forming a protective layer.

Example 4

A heat-sensitive recording material (4) of the invention was produced in the same way as in Example 1 except that the 5% solution of SURFYNOL 104E in methanol was changed to a 5% solution of nonionic surfactant (trade name: SURFYNOL 485, manufactured by Nissin Chemical Industry Co., Ltd.) in methanol in the preparation of the coating solution for forming a protective layer.

Example 5

A heat-sensitive recording material (5) of the invention was produced in the same way as in Example 4 except that the amount of the 5% solution of SURFYNOL 485 (described above) in methanol to be added was changed from 15.58 g to 46.74 g in the preparation of the coating solution for forming a protective layer.

Example 6

A heat-sensitive recording material (6) of the invention was produced in the same way as in Example 4 except that the coating speed was changed from 160 m/min to 70 m/min in the preparation of the heat-sensitive recording material.

Comparative Example 1

A heat-sensitive recording material (7), which was a comparative example, was produced in the same way as in Example 1 except that an addition of 0.78 g of an ammonium salt of 2-ethylhexylsulfosuccinic acid was performed instead of the addition of 15.58 g of the 5% solution of SURFYNOL 104E (described above) in methanol in the preparation of the coating solution for forming a protective layer.

Comparative Example 2

A heat-sensitive recording material (8), which was a comparative example, was produced in the same way as in Example 1 except that the addition of the 5% solution of SURFYNOL 104E (described above) in methanol was not performed in the preparation of the coating solution for forming a protective layer.

Comparative Example 3

A heat-sensitive recording material (9), which was a comparative example, was produced in the same manner as in Comparative Example 1 except that the coating speed was changed from 160 m/min to 70 m/min.

Comparative Example 4

A heat-sensitive recording material (10), which was a comparative example, was produced in the same way as in Comparative Example 2 except that the coating speed was changed from 160 m/min to 70 m/min.

Evaluation (1) Evaluation of the Surface State

Defects or deficiencies on the surface of the protective layer of each heat-sensitive recording materials (1) to (10) were observed with the naked eye, and then the state of the surface was evaluated based on the following criterion. The results are shown in Table 1.

◎: No defect or deficiency was observed.

○: Defects or deficiencies were scarcely recognizable. However, the sizes of the defects or deficiencies were so small that no practical problems occurred.

Δ: Defects or deficiencies were easily recognized with the naked eye. However, the defects or deficiencies were not so severe and caused few practical problems.

X: Many defects or deficiencies were observed, causing practical problems.

(2) The Number of Deficiencies

Each of the heat-sensitive recording materials (1) to (10) was subjected to heat treatment such that the transmission density thereof became a value in the range of 1.2 to 1.6, and then the number (per B4 size area) of sensitized spot deficiencies having a size of 0.5 to 2 mm was counted as the number of deficiencies. The results are shown in Table 1.

TABLE 1

| | Additive | | | Evaluation results | |
|---|---|---|---|---|---|
| | Kind | Content of the additive in solid content (% by mass) | Application speed (m/min) | Surface state | The number of deficiencies |
| Example 1 | SURFYNOL 104E | 2.4 | 160 | ◎ | 0–2 |
| Example 2 | Olfin E1004 | 2.4 | 160 | ○ | 10 |
| Example 3 | Olfin E1010 | 2.4 | 160 | ○ | 12 |
| Example 4 | SURFYNOL 485 | 2.4 | 160 | ○ | 31 |
| Example 5 | SURFYNOL 485 | 7.2 | 160 | ○ | 5 |
| Example 6 | SURFYNOL 485 | 2.4 | 70 | ○ | 4 |
| Comparative Example 1 | Ammonium salt of 2-ethylhexylsulfosuccinic acid | 2.4 | 160 | Δ | 450 |
| Comparative Example 2 | — | 0 | 160 | X | 2600 |
| Comparative Example 3 | Ammonium salt of 2-ethylhexylsulfosuccinic acid | 2.4 | 70 | Δ~○ | 104 |
| Comparative Example 4 | — | 0 | 70 | X | 1150 |

As is clear from the results shown in Table 1, the heat-sensitive recording materials (1) to (6) of the invention had few deficiencies and their surface states were good.

According to the invention, it is possible to provide a heat-sensitive recording material which has a good surface state and is capable of forming a high-quality image.

What is claimed is:

1. A heat-sensitive recording material comprising, on a support, at least a heat-sensitive recording layer and a protective layer in that order, wherein the protective layer contains an acetylene glycol derivative represented by the following formula (1) in an amount of 2% or more by mass of solid content in the protective layer, a water-insoluble dispersion in an amount of 5% or more by mass of the solid content in the protective layer, and a water-insoluble organic material in a form of an emulsion in an amount of 5% or more by mass of the solid content in the protective layer:

Formula (1)

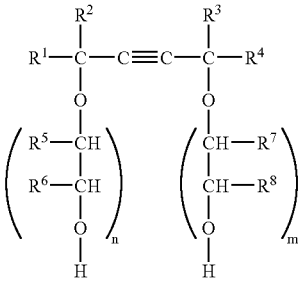

wherein in formula (1), $R^1$ to $R^4$ each independently represent a hydrogen atom, a branched, linear or cyclic substituted or unsubstituted alkyl group having 1 to 8 carbon atoms, or a substituted or unsubstituted aryl group having 6 to 10 carbon atoms; $R^5$ to $R^8$ each independently represent a hydrogen atom or a methyl group; and n and m each independently represent an integer of 0 to 50, and wherein:

(i) the water-insoluble dispersion comprises an inorganic pigment having a 50%-volume-average particle size of 0.10 to 5.00 μm, and the inorganic pigment is coated with at least one selected from the group consisting of higher fatty acids, metal salts of higher fatty acids, and higher alcohols; and/or (ii) the water-insoluble organic material comprises a lubricant which is in liquid form at ordinary temperature and the lubricant is selected from the group consisting of silicone oil, liquid paraffin and lanolin.

2. A heat-sensitive recording material according to claim 1, wherein the sum of n and m in formula (1) is 6 or less.

3. A heat-sensitive recording material according to claim 1, wherein $R^1$ in formula (1) is selected from the group consisting of methyl, ethyl, n-propyl, isopropyl, n-butyl, isobutyl, cyclohexyl, phenyl and naphthyl groups.

4. A heat-sensitive recording material according to claim 1, wherein $R^2$ in formula (1) is selected from the group consisting of methyl, ethyl, n-propyl, isopropyl, n-butyl, isobutyl, cyclohexyl, phenyl and naphthyl groups.

5. A heat-sensitive recording material according to claim 1, wherein $R^3$ in formula (1) is selected from the group consisting of methyl, ethyl, n-propyl, isopropyl, n-butyl, isobutyl, cyclohexyl, phenyl and naphthyl groups.

6. A heat-sensitive recording material according to claim 1, wherein $R^4$ in formula (1) is selected from the group consisting of methyl, ethyl, n-propyl, isopropyl, n-butyl, isobutyl, cyclohexyl, phenyl and naphthyl groups.

7. A heat-sensitive recording material according to claim 1, wherein the inorganic pigment is selected from the group consisting of calcium carbonate, titanium oxide, kaolin, aluminum hydroxide, amorphous silica, and zinc oxide.

8. A heat-sensitive recording material according to claim 1, wherein the water-insoluble dispersion comprises an inorganic pigment having a 50%-volume-average particle size of 0.10 to 5.00 μm, and the inorganic pigment is coated with at least one selected from the group consisting of higher fatty acids, metal salts of higher fatty acids, and higher alcohols.

9. A heat-sensitive recording material according to claim 1, wherein the water-insoluble dispersion comprises a surface gloss adjusting agent.

10. A heat-sensitive recording material according to claim 1, wherein the water-insoluble dispersion comprises a matting agent.

11. A heat-sensitive recording material according to claim 1, wherein the water-insoluble organic material comprises a lubricant which has a melting point of 160° C. or less, and is in solid form at ordinary temperature.

12. A heat-sensitive recording material according to claim 1, wherein the water-insoluble organic material comprises a lubricant which is in liquid form at ordinary temperature and the lubricant is selected from the group consisting of silicone oil, liquid paraffin and lanolin.

13. A heat-sensitive recording material according to claim 1, wherein the water-insoluble organic material has an average particle diameter of 0.1 to 5.0 μm.

14. A heat-sensitive recording material according to claim 1, wherein the protective layer further comprises a binder selected from the group consisting of polyvinyl alcohol, carboxy-modified polyvinyl alcohol, and silica-modified polyvinyl alcohol.

15. A heat-sensitive recording material according to claim 1, wherein the dry coated amount of the protective layer is from 0.2 to 7 $g/m^2$.

16. A heat-sensitive recording material according to claim 1, wherein the support is a polymer film.

17. A heat-sensitive recording material according to claim 1, wherein all of the layers are simultaneously formed by multi-layer coating with an extruding die.

18. A heat-sensitive recording material according to claim 17, wherein the coating speed of the layers in the multi-layer coating is 100 m/min or more.

* * * * *